US010187739B2

(12) United States Patent
Goodwin et al.

(10) Patent No.: US 10,187,739 B2
(45) **Date of Patent: *Jan. 22, 2019**

(54) SYSTEM AND METHOD FOR CAPTURING, ENCODING, DISTRIBUTING, AND DECODING IMMERSIVE AUDIO

(71) Applicant: DTS, Inc., Calabasas, CA (US)

(72) Inventors: Michael M. Goodwin, Scotts Valley, CA (US); Jean-Marc Jot, Aptos, CA (US); Martin Walsh, Scotts Valley, CA (US)

(73) Assignee: DTS, Inc., Calabasas, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/785,234

(22) Filed: Oct. 16, 2017

(65) Prior Publication Data

US 2018/0098174 A1 Apr. 5, 2018

Related U.S. Application Data

(63) Continuation of application No. 15/011,320, filed on Jan. 29, 2016, now Pat. No. 9,794,721.

(Continued)

(51) Int. Cl.

*H04R 5/00* (2006.01)
*H04S 7/00* (2006.01)

(Continued)

(52) U.S. Cl.

CPC ..... *H04S 7/303* (2013.01); *G10L 19/008* (2013.01); *H04R 1/32* (2013.01); *H04R 2410/07* (2013.01);

(Continued)

(58) Field of Classification Search

CPC ..... H04S 3/006; H04S 2400/15; H04R 3/005; H04R 5/027; H04R 2430/21

(Continued)

(56) References Cited

U.S. PATENT DOCUMENTS 6,072,878 A 6/2000 Moorer
6,904,152 B1 6/2005 Moorer (Continued)

FOREIGN PATENT DOCUMENTS

WO 2013/186593 12/2013

OTHER PUBLICATIONS

International Search Report and Written Opinion, dated Apr. 14, 2016, in related PCT Application No. PCT/US2016/15818, 8 pages.

(Continued)

*Primary Examiner* — Thjuan K Addy
(74) *Attorney, Agent, or Firm* — Craig S. Fischer

(57) ABSTRACT

A sound field coding system and method that provides flexible capture, distribution, and reproduction of immersive audio recordings encoded in a generic digital audio format compatible with standard two-channel or multi-channel reproduction systems. This end-to-end system and method mitigates any impractical need for standard multi-channel microphone array configurations in consumer mobile devices such as smart phones or cameras. The system and method capture and spatially encode two-channel or multi-channel immersive audio signals that are compatible with legacy playback systems from flexible multi-channel microphone array configurations.

14 Claims, 17 Drawing Sheets

Related U.S. Application Data

(60) Provisional application No. 62/110,211, filed on Jan. 30, 2015.

(51) Int. Cl.

| | |
|---|---|
| ***G10L 19/008*** | (2013.01) |
| ***H04R 1/32*** | (2006.01) |
| *H04S 1/00* | (2006.01) |
| *H04S 3/00* | (2006.01) |

(52) U.S. Cl.
CPC ..... *H04S 1/007* (2013.01); *H04S 3/008* (2013.01); *H04S 7/304* (2013.01); *H04S 2400/11* (2013.01); *H04S 2400/15* (2013.01); *H04S 2420/01* (2013.01); *H04S 2420/03* (2013.01); *H04S 2420/11* (2013.01)

(58) Field of Classification Search
USPC ..... 381/20, 17, 61, 18, 19, 27
See application file for complete search history.

(56) References Cited

U.S. PATENT DOCUMENTS

| | | | | |
|---|---|---|---|---|
| 8,023,660 | B2 | 9/2011 | Faller | |
| 8,041,043 | B2 | 10/2011 | Faller | |
| 2005/0141728 | A1 | 6/2005 | Moorer | |
| 2007/0269063 | A1 | 11/2007 | Goodwin et al. | |
| 2008/0004729 | A1 | 1/2008 | Hiipakka | |
| 2008/0205676 | A1 | 8/2008 | Merimaa et al. | |
| 2008/0298597 | A1 | 12/2008 | Turku et al. | |
| 2009/0092259 | A1 | 4/2009 | Jot et al. | |
| 2009/0252356 | A1 | 10/2009 | Goodwin | |
| 2010/0061558 | A1 | 3/2010 | Faller | |
| 2010/0322431 | A1 | 12/2010 | Lokki et al. | |
| 2012/0114126 | A1 | 5/2012 | Thiergart et al. | |
| 2012/0155653 | A1 | 6/2012 | Jax et al. | |
| 2013/0044894 | A1 | 2/2013 | Samsudin et al. | |
| 2013/0142342 | A1* | 6/2013 | Del Galdo ..... | H04R 3/005 381/56 |
| 2013/0259243 | A1 | 10/2013 | Herre et al. | |
| 2014/0029460 | A1 | 1/2014 | Xin et al. | |

OTHER PUBLICATIONS

Vilkamo Juha et al: "Directional Audio Coding: Virtual Microphone-Based Synthesis and Subjective Evaluation", JAES, AES, 60 East 42nd Street, Room 2520, New York 10165-2520, USA, vol. 57, No. 9, Sep. 1, 2009.

European Patent Office Extended European Search Report, in related European Patent Application No. 16744238.3-1914, 8 pages.

* cited by examiner

SYSTEM AND METHOD FOR CAPTURING, ENCODING, DISTRIBUTING, AND DECODING IMMERSIVE AUDIO

CROSS-REFERENCE TO RELATED APPLICATIONS

This application is a continuation application of U.S. Ser. No. 15/011,320 entitled "SYSTEM AND METHOD FOR CAPTURING, ENCODING, DISTRIBUTING, AND DECODING IMMERSIVE AUDIO" filed on Jan. 29, 2016, now allowed, which claims benefit of priority under 35 U.S.C. 119(e) to U.S. Provisional Patent Application Ser. No. 62/110,211 filed on Jan. 30, 2015, entitled "SYSTEM AND METHOD FOR CAPTURING AND ENCODING A 3-D AUDIO SOUNDFIELD", the entire contents of which are incorporated by reference.

BACKGROUND

Capture of audio content, often in conjunction with video, has become increasingly common as dedicated recording devices have become more portable and affordable and as recording capabilities have become more pervasive in everyday devices such as smartphones. The quality of video capture has consistently increased and has outpaced the quality of audio capture. Video capture on modern mobile devices is typically high-resolution and DSP-processing intensive, but accompanying audio content is generally captured in mono with low fidelity and little additional processing.

In order to capture spatial cues, many existing audio recording techniques employ at least two microphones. As a general rule, recording a 360-degree horizontal surround audio scene requires at least 3 audio channels, whereas recording a three-dimensional audio scene requires at least 4 audio channels. While multichannel audio capture is used for immersive audio recording, the more pervasive consumer audio delivery technologies and distribution frameworks currently available are limited to transmitting two-channel audio. In standard two-channel stereo reproduction, the stored or transmitted left and right audio channels are intended to be directly played back respectively on left and right loudspeakers or headphones.

For playback of immersive audio recordings, it may be necessary to render the recorded spatial audio information in a variety of playback configurations. These playback configurations include headphones, frontal sound-bar loudspeakers, frontal discrete loudspeaker pairs, 5.1 horizontal surround loudspeaker arrays, and three-dimensional loudspeaker arrays comprising height channels. Irrespective of the playback configuration, it is desirable to reproduce for the listener a spatial audio scene that is a substantially accurate representation of the captured audio scene. Additionally, it is advantageous to provide an audio storage or transmission format that is agnostic to the particular playback configuration.

One such configuration-agnostic format is the B-format. The B-format includes the following signals: (1) W—a pressure signal corresponding to the output of an omnidirectional microphone; (2) X—front-to-back directional information corresponding to the output of a forward-pointing "figure-of-eight" microphone; (3) Y—side-to-side directional information corresponding to the output of a leftward-pointing "figure-of-eight" microphone; and (4) Z—up-to-down directional information corresponding to the output of an upward-pointing "figure-of-eight" microphone.

A B-format audio signal may be spatially decoded for immersive audio playback on headphones or flexible loudspeaker configurations. A B-format signal can be obtained directly or derived from standard near-coincident microphone arrangements, which include an omnidirectional and/or bi-directional microphones or uni-directional microphones. In particular, the 4-channel A-format is obtained from a tetrahedral arrangement of cardioid microphones and may be converted to the B-format via a 4×4 linear matrix. Additionally, the 4-channel B-format may be converted to a two-channel Ambisonic UHJ format that is compatible with standard 2-channel stereo reproduction. However, the two-channel Ambisonic UHJ format is not sufficient to enable faithful three-dimensional immersive audio or horizontal surround reproduction.

Other approaches have been proposed for encoding a plurality of audio channels representing a surround or immersive sound scene into a reduced-data format for storage and/or distribution that can subsequently be decoded to enable a faithful reproduction of the original audio scene. One such approach is time-domain phase-amplitude matrix encoding/decoding. The encoder in this approach linearly combines the input channels with specified amplitude and phase relationships into a smaller set of coded channels. The decoder combines the encoded channels with specified amplitudes and phases to attempt to recover the original channels. However, as a consequence of the intermediate channel-count reduction, there can be a loss in spatial localization fidelity of the reproduced audio scene compared to the original audio scene.

An approach for improving the spatial localization fidelity of the reproduced audio scene is frequency-domain phase-amplitude matrix decoding, which decomposes the matrix-encoded two-channel audio signal into a time-frequency representation. This approach then separately spatializes the respective time-frequency components. The time-frequency decomposition provides a high-resolution representation of the input audio signals where individual sources are represented more discretely than in the time domain. As a result, this approach can improve the spatial fidelity of the subsequently decoded signal, when compared to time-domain matrix decoding.

Another approach to data reduction for multichannel audio representation is spatial audio coding. In this approach the input channels are combined into a reduced-channel format (potentially even mono) and some side information about the spatial characteristics of the audio scene is also included. The parameters in the side information can be used to spatially decode the reduced-channel format into a multichannel signal that faithfully approximates the original audio scene.

The phase-amplitude matrix encoding and spatial audio coding methods described above are often concerned with encoding multichannel audio tracks created in recording studios. Moreover, they are sometimes concerned with a requirement that the reduced-channel encoded audio signal be a viable listening alternative to the fully decoded version. This is so that direct playback is an option and a custom decoder is not required.

Sound field coding is a similar endeavor to spatial audio coding that is focused on capturing and encoding a "live" audio scene and reproducing that audio scene accurately over a playback system. Existing approaches to sound field coding depend on specific microphone configurations to capture directional sources accurately. Moreover, they rely on various analysis techniques to appropriately treat directional and diffuse sources. However, the microphone configurations required for sound field coding are often impractical for consumer devices. Modern consumer devices typically have significant design constraints imposed on the number and positions of microphones, which can result in configurations that are mismatched with the requirements for current sound field encoding methods. The sound field analysis methods are often also computationally intensive, lacking scalability to support lower-complexity realizations.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Embodiments of the sound field coding system and method relate to the processing of audio signals more particularly to the capture, encoding and reproduction of three-dimensional (3-D) audio sound fields. Embodiments of the system and method are used to capture 3-D sound field that represent an immersive audio scene. This capture is performed using an arbitrary microphone array configuration. The captured audio is encoded for efficient storage and distribution into a generic Spatially Encoded Signal (SES) format. In some embodiments the methods for spatially decoding this SES format for reproduction are agnostic to the microphone array configuration used to capture the audio in the 3-D sound field.

There are currently no end-to-end system enabling flexible capture, distribution, and reproduction of immersive audio recordings encoded in a generic digital audio format compatible with standard two-channel and multi-channel reproduction systems. In particular, since adopting standard multi-channel microphone array configurations is not practical in consumer mobile devices such as smart phones or cameras, methods for spatially encoding two-channel or multi-channel immersive audio signals compatible with legacy playback systems from flexible multi-channel microphone array configurations are needed.

Embodiments of the system and method include processing a plurality of microphone signals by selecting a microphone configuration having multiple microphones to capture a 3-D sound filed. The microphones are used to capture sound from at least one audio source. The microphone configuration defines a microphone directivity for each of the multiple microphones used in the audio capture. The microphone directivity is defined relative to a reference direction.

Embodiments of the system and method also include selecting a virtual microphone configuration containing multiple microphones. The virtual microphone configuration is used in the encoding of spatial information about a position of the audio source relative to the reference direction. The system and method also include calculating spatial encoding coefficients based on the microphone configuration and on the virtual microphone configuration. The spatial encoding coefficients are used to convert the microphone signals into a Spatially Encoded Signal (SES). The SES includes virtual microphone signals, where the virtual microphone signals are obtained by combining the microphone signals using the spatial encoding coefficients.

Embodiments of the system and method also include a method for processing a plurality of capture microphone signals. The method includes selecting a capture microphone configuration having a plurality of capture microphones for capturing sound from at least one audio source, where the capture microphone configuration defines a microphone directivity for each of the plurality of capture microphones relative to a reference direction. The method further includes selecting a virtual microphone configuration having a plurality of virtual microphones for encoding spatial information about a position of the at least one audio source relative to the reference direction. The virtual microphone configuration defines a virtual microphone directivity for each of the virtual microphones relative to the reference direction. The method further includes adapting the capture microphone configuration based on detection of an adverse condition for microphone performance for at least one of the plurality of capture microphones to obtain an adapted capture microphone configuration, and calculating spatial encoding coefficients based on the adapted capture microphone configuration and on the virtual microphone configuration. The method also includes converting the plurality of capture microphone signals into a Spatially Encoded Signal (SES) including virtual microphone signals. In some embodiments each of the virtual microphone signals is obtained by combining the capture microphone signals using the spatial encoding coefficients.

Embodiments of the system and method further include a method for processing a plurality of capture microphone signals. The method includes decomposing the plurality of capture microphone signals into a plurality of direct components and a plurality of diffuse components. The method further includes selecting a first capture microphone configuration for the direct components having a first plurality of capture microphones for capturing sound from at least one audio source, where the first capture microphone configuration defines a first microphone directivity for each of the first plurality of capture microphones relative to a first reference direction. The method also includes selecting a first virtual microphone configuration for the direct components having a first plurality of virtual microphones for encoding spatial information about a position of the at least one audio source relative to the reference direction, the first virtual microphone configuration defining a first virtual microphone directivity for each of the virtual microphones relative to the first reference direction. The method also includes selecting a second capture microphone configuration for the diffuse components having a second plurality of capture microphones for capturing sound from at least one audio source, where the second capture microphone configuration defines a second microphone directivity for each of the second plurality of capture microphones relative to a second reference direction. The method further includes selecting a second virtual microphone configuration for the diffuse components having a second plurality of virtual microphones for encoding spatial information about a position of the at least one audio source relative to the second reference direction, where the second virtual microphone configuration defines a second virtual microphone directivity for each of the virtual microphones relative to the second reference direction. Moreover, the method includes calculating spatial encoding coefficients for the direct components based on the first and second capture microphone configurations for the direct components and on the first and second virtual microphone configurations for the direct components, and calculating spatial encoding coefficients for the diffuse components based on the first and second capture microphone configurations for the diffuse components and on the first and second virtual microphone configurations for the diffuse components. The method further includes converting the plurality of direct components into a direct-component Spatially Encoded Signal (SES) including virtual microphone signals for the direct components, wherein each of the virtual microphone signals for the direct components is obtained by combining the direct components using the spatial encoding coefficients for the direct components, and converting the plurality of diffuse components into a diffuse-component Spatially Encoded Signal (SES) including virtual microphone signals for the diffuse components, where each of the virtual microphone signals for the diffuse components is obtained by combining the diffuse components using the spatial encoding coefficients for the diffuse components. Finally, the method includes combining the direct-component Spatially Encoded Signal and the diffuse-component Spatially Encoded Signal to form an output Spatially Encoded Signal.

It should be noted that alternative embodiments are possible, and steps and elements discussed herein may be changed, added, or eliminated, depending on the particular embodiment. These alternative embodiments include alternative steps and alternative elements that may be used, and structural changes that may be made, without departing from the scope of the invention.

DRAWINGS DESCRIPTION

Referring now to the drawings in which like reference numbers represent corresponding parts throughout:

DETAILED DESCRIPTION

In the following description of embodiments of a sound field coding system and method reference is made to the accompanying drawings. These drawings show by way of illustration specific examples of how embodiments of the system and method may be practiced. It is understood that other embodiments may be utilized and structural changes may be made without departing from the scope of the claimed subject matter.

I. System Overview

Embodiments of the sound field coding system and method described herein are used to capture a sound field representing an immersive audio scene using an arbitrary microphone array configuration. The captured audio is encoded for efficient storage and distribution into a generic Spatially Encoded Signal (SES) format. In preferred embodiments of the present invention, methods for spatially decoding this SES format for reproduction are agnostic to the microphone array configuration used. The storage and distribution can be realized using existing approaches for two-channel audio, for example commonly used digital media distribution or streaming networks. The SES format can be played back on a standard two-channel stereo reproduction system or, alternatively, reproduced with high spatial fidelity on flexible playback configurations (if an appropriate SES decoder is available). The SES encoding format enables spatial decoding configured to achieve faithful reproduction of an original immersive audio scene in a variety of playback configurations, for instance headphones or surround sound systems.

Embodiments of the sound field coding system and method provide flexible and scalable techniques for capturing and encoding a three-dimensional sound field with an arbitrary configuration of microphones. This is distinct from existing methods in that a specific microphone configuration is not required. Furthermore, the SES encoding format described herein is viable for high-quality two-channel playback without requiring a spatial decoder. This is a distinction from other three-dimensional sound field coding methods (such as the Ambisonic B-format or DirAC) in that those are typically not concerned with providing faithful immersive 3-D audio playback directly from the encoded audio signals. Moreover, these coding methods may be unable to provide a high-quality playback without including side information in the encoded signal. Side information is optional with embodiments of the system and method described herein.

Capture, Encoding and Distribution System

Figure 1:
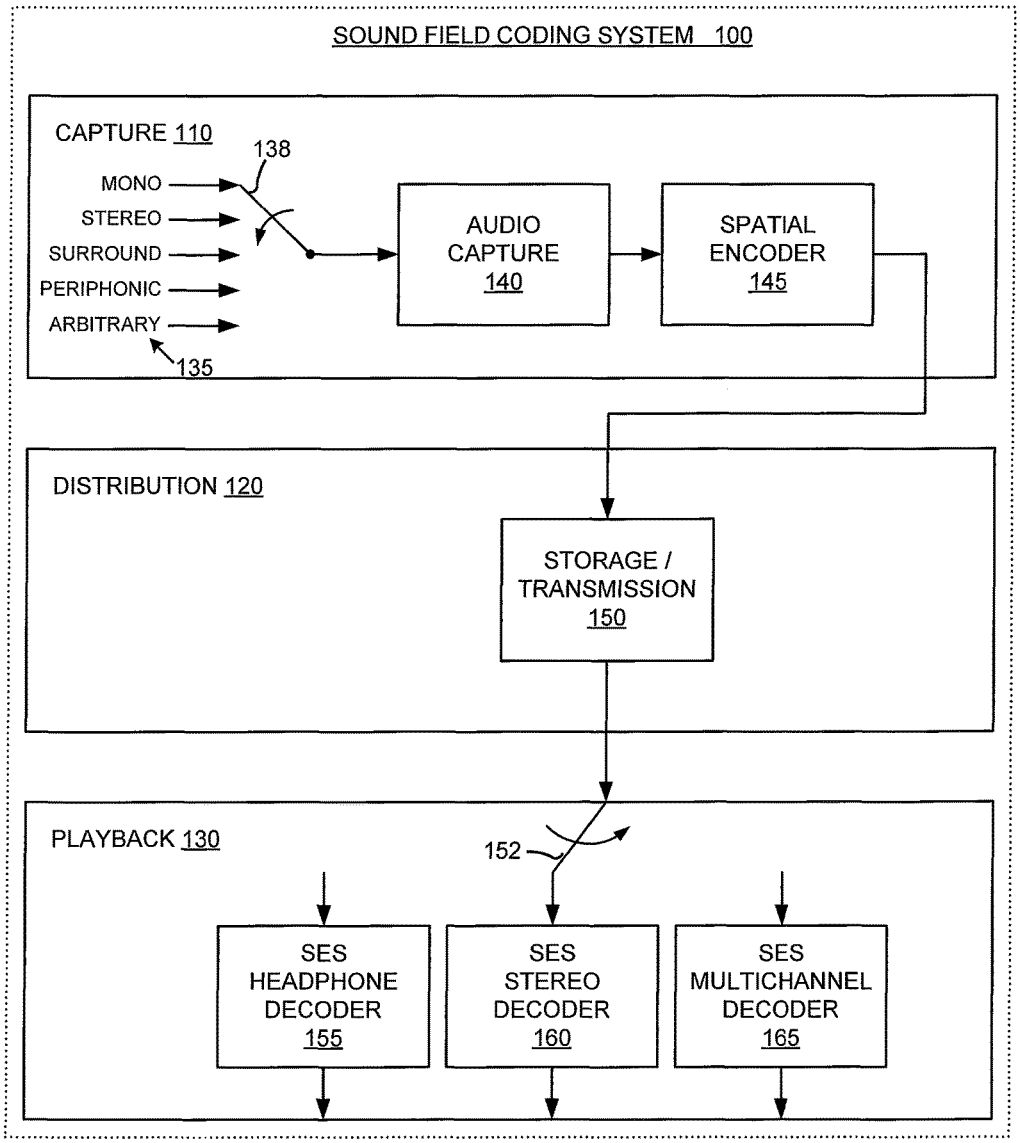
FIG. 1 is an overview block diagram of an embodiment of a sound field coding system according to the present invention.

FIG. 1 is an overview block diagram of an embodiment of the sound field coding system 100. The system 100 includes a capture component 110, a distribution component 120, and a playback component 130. In the capture component, an input microphone or preferably a microphone array receives audio signals. The capture component 110 accepts microphone signals 135 from a variety of microphone configurations. By way of example, these configurations include mono, stereo, 3-microphone surround, 4-microphone periphonic (such as Ambisonic B-format), or arbitrary microphone configurations. A first symbol 138 illustrates that any one of the microphone signal formats can be selected as input. The microphone signals 135 are input to an audio capture component 140. In some embodiments of the system 100 the microphone signals 135 are processed by the audio capture component 140 to remove undesired environmental noise (such as stationary background noise or wind noise).

The captured audio signals are input to a spatial encoder 145. These audio signals are spatially encoded into a Spatially Encoded Signal (SES) format suitable for subsequent storage and distribution. The subsequent SES is passed to a storage/transmission component 150 of the distribution component 120. In some embodiments the SES is coded by the storage/transmission component 150 with an audio waveform encoder (such as MP3 or AAC) in order to reduce the storage requirement or transmission data rate without modifying the spatial cues encoded in the SES. In the distribution component 120 the audio is stored or provided over a distribution network to playback devices.

In the playback component 130 a variety of playback devices are depicted. As depicted by a second symbol 152, any of the playback devices may be selected. A first playback device 155, a second playback device 160, and a third playback device 165 are shown in FIG. 1. For the first playback device 155, the SES is spatially decoded for optimal playback over headphones. For the second playback device 160, the SES is spatially decoded for optimal playback over a stereo system. For the third playback device 165, the SES signal is spatially decoded for optimal playback over a multichannel loudspeaker system. In common usage scenarios, the audio capture, distribution, and playback may occur in conjunction with video, as will be understood by those of skill in the art and illustrated in the following figures.

Figure 2A:
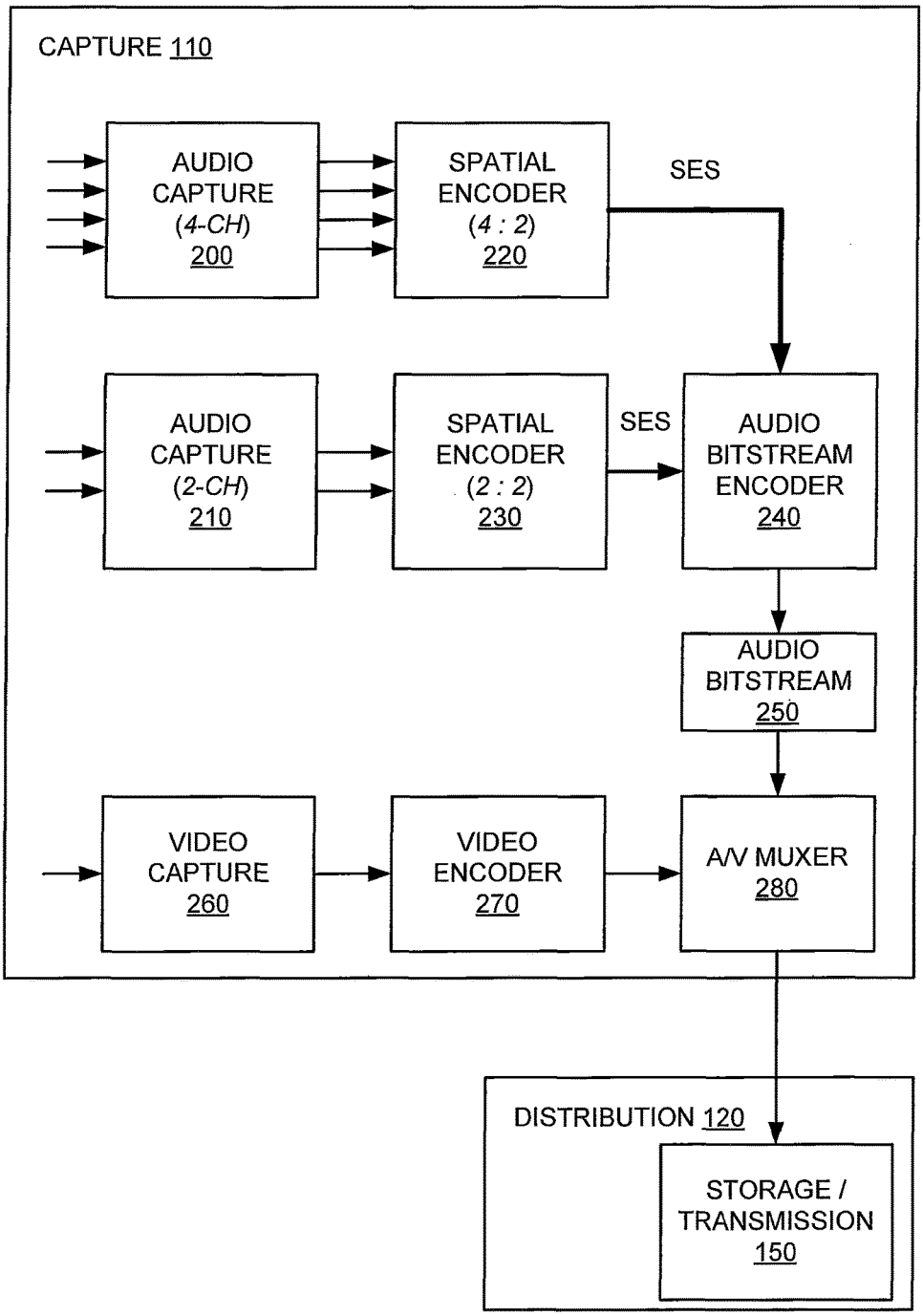
FIG. 2A is a block diagram illustrating details of the capture, encoding and distribution components of embodiments of the sound field coding system shown in FIG. 1.

FIG. 2A is a block diagram illustrating the details of the capture component 110 of the sound field coding system 100 shown in FIG. 1. In the capture component 110, a recording device supports both a four-microphone array connected to first audio capture sub-component 200 and a two-microphone array connected to a second audio capture sub-component 210. The outputs of the first and second audio capture sub-components 200 and 210 are respectively provided to a first spatial encoder sub-component 220 and a second spatial encoder sub-component 230 where they are encoded into a Spatially Encoded Signal (SES) format. It should be noted that embodiments of the system 100 are not limited to two-microphone or four-microphone arrays. In other cases, other microphone configurations would be similarly supported with appropriate spatial encoders. In some embodiments the SES generated by the first spatial encoder sub-component 220 or by the second spatial encoder sub-component 230 are encoded by an audio bitstream encoder 240. The encoded signal that is output from the encoder 240 is packed into an audio bitstream 250.

In some embodiments video is included in the capture component 110. As shown in FIG. 2A, a video capture component 260 captures a video signal and a video encoder 270 encodes the video signal to produce a video bitstream. An A/V muxer 280 multiplexes the audio bitstream 250 with the associated video bitstream. The multiplexed audio and video bitstream is stored or transmitted in the storage/transmission component 150 of the distribution component 120. The bitstream data may be temporarily stored as a data file on the capture device, on a local media server, or in a computer network, and made available for transmission or distribution.

In some embodiments the first audio capture sub-component 200 captures an Ambisonic B-format signal and the SES encoding by the first spatial encoder sub-component 220 performs a conventional B-format to UHJ two-channel stereo encoding, as described, for instance, in "Ambisonics in multichannel broadcasting and video," Michael Gerzon, JAES Vol 33, No 11, November 1985 p. 859-871. In alternative embodiments, the first spatial encoder sub-component 220 performs frequency-domain spatial encoding of the B-format signal into a two-channel SES, which, unlike the two-channel UHJ format, can retain three-dimensional spatial audio cues. In yet another embodiment the microphones connected to first audio capture sub-component 200 are arranged in a non-standard configuration.

Figure 2B:
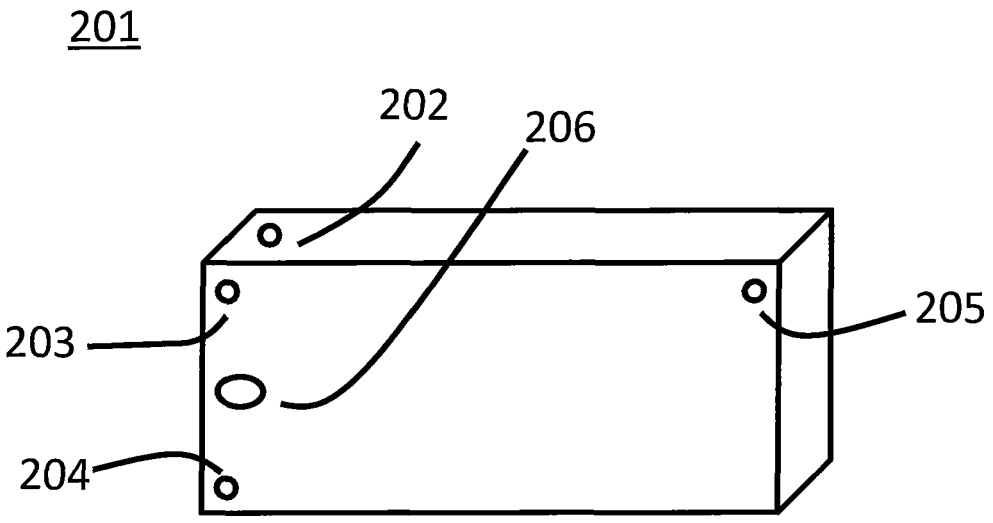
FIG. 2B is a block diagram illustrating an embodiment of a portable capture device with microphones arranged in a non-standard configuration.

FIG. 2B is a diagram illustrating an embodiment of a portable capture device 201 with microphones arranged in a non-standard configuration. The portable capture device 201 in FIG. 2B includes microphones 202, 203, 204, and 205 for audio capture and a camera 206 for video capture. In portable devices such as smartphones, the locations of microphones on the device 201 may be constrained by industrial design considerations or other factors. Due to such constraints, the microphones 202, 203, 204, and 205 may be configured in a way that is not a standard microphone configuration such as the recording microphone configurations recognized by those of skill in the art. Indeed, the configuration may be specific to the particular capture device. FIG. 2B merely provides an example of such a device-specific configuration. It should be noted that various other embodiments are possible and not limited to this particular microphone configuration. In addition, embodiments of the invention are applicable to arbitrary configurations of microphones.

In alternative embodiments only two microphone signals are captured (by the second audio capture sub-component 210) and spatially encoded (by the second spatial encoder sub-component 230). This limitation to two microphone channels may occur, for example, when there is a product design decision to minimize device manufacturing cost. In this case, the fidelity of the spatial information encoded in the SES may be compromised accordingly. For instance, the SES may be lacking up versus down or front versus back discrimination cues. However, in an advantageous embodiment of the invention, the left versus right discrimination cues encoded in the SES produced from the second spatial encoder sub-component 230 are substantially equivalent to those encoded in the SES produced from the first spatial encoder sub-component 220 (as perceived by a listener in a standard two-channel stereo playback configuration) for the same original captured sound field. Therefore, the SES format remains compatible with standard two-channel stereo reproduction irrespective of the capture microphone array configuration.

In some embodiments the first spatial encoder sub-component 220 also produces spatial audio side information or metadata included in the SES. This side information is derived in some embodiments from a frequency-domain analysis of the inter-channel relationships between the captured microphone signals. Such spatial audio side information is incorporated into the audio bitstream by the audio bitstream encoder 240 and subsequently stored or transmitted so that it may be optionally retrieved in the playback component and exploited in order to optimize spatial audio reproduction fidelity.

More generally, in some embodiments the digital audio bitstream produced by the audio bitstream encoder 240 is formatted to include a two-channel or multi-channel backward-compatible audio downmix signal along with optional extensions (referred to herein as "side information") that can include metadata and additional audio channels. An example of such an audio coding format is described in US patent application US2014-0350944 A1 entitled "Encoding and reproduction of three dimensional audio soundtracks", which is incorporated by reference herein in its entirety.

While it is often useful to perform the spatial encoding before multiplexing audio and video (for legacy and compatibility purposes) as depicted in FIG. 2A, in other embodiments the originally captured multichannel audio signal may be multiplexed with the video "as is", and SES encoding can take place at some later stage in the delivery chain. For example, the spatial encoding, including optional side information extraction, can be performed offline on a network-based computer. This approach may allow for more advanced signal analysis computations than may be realizable when spatial encoding computations are implemented on the original recording device processor.

In some embodiments the two-channel SES encoded by the audio bitstream encoder 240 contains the spatial audio cues captured in the original sound field. In some embodiments the audio cues are in the form of inter-channel amplitude and phase relationships that are substantially agnostic to the particular microphone array configuration employed on the capture device (within fidelity limits imposed by the number of microphones and the geometry of the microphone array). The two-channel SES can later be decoded by extracting the encoded spatial audio cues and rendering audio signals that are optimal for reproducing the spatial cues representing the original audio scene over the available playback device.

Figure 3:
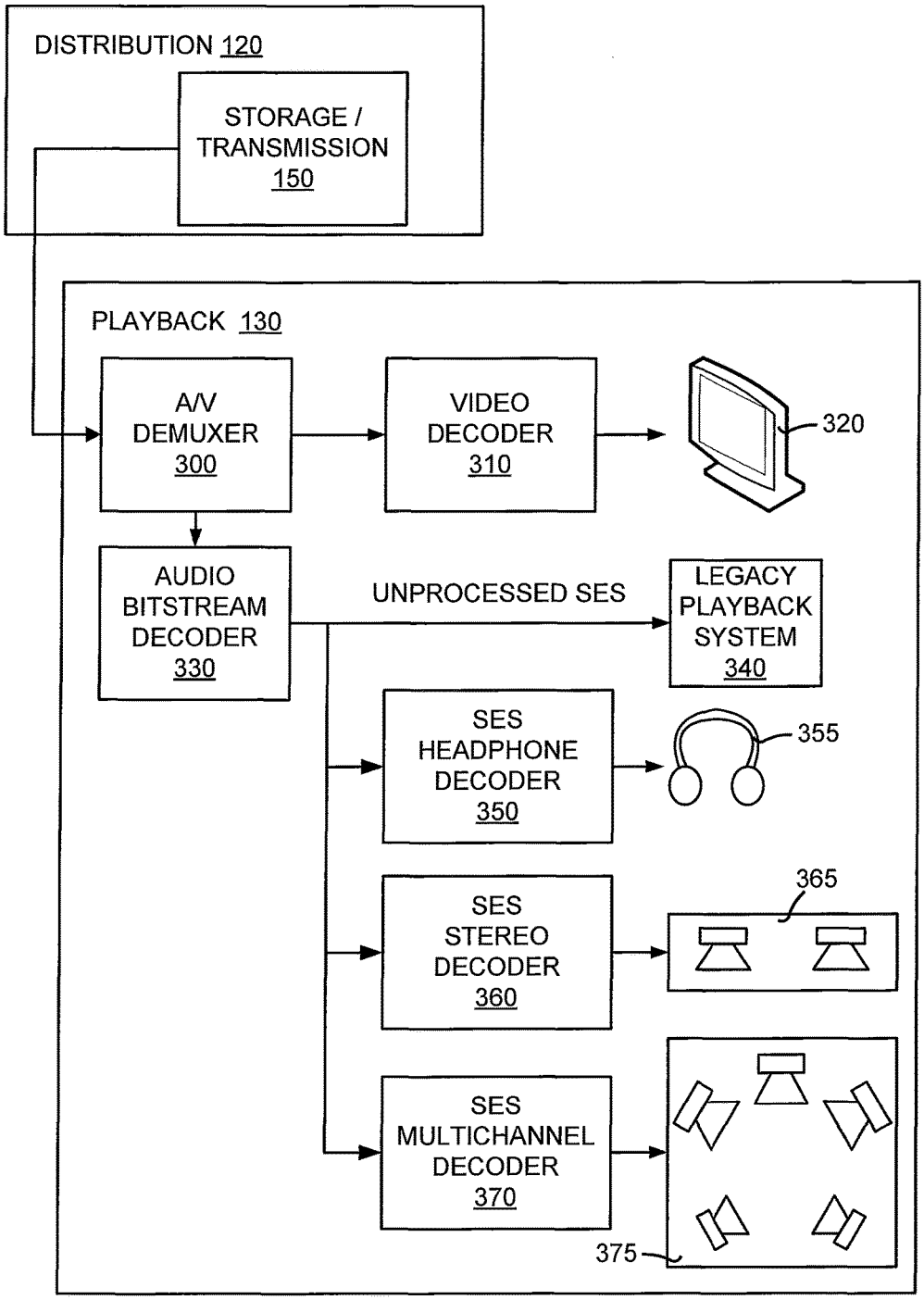
FIG. 3 is a block diagram illustrating details of the decoding and playback component of embodiments of the sound field coding system shown in FIG. 1.

FIG. 3 is a block diagram illustrating the details of the playback component 130 of the sound field coding system 100 shown in FIG. 1. The playback component 130 receives a media bitstream from the storage/transmission component 150 of the distribution component 120. In embodiments where the received bitstream includes both audio and video bitstreams, these bitstreams are demultiplexed by an A/V demuxer 300. The video bitstream is provided to a video decoder 310 for decoding and playback on a monitor 320. The audio bitstream is provided to an audio bitstream decoder 330 that recovers the original encoded SES exactly or in a form that preserves the spatial cues encoded in the SES. For instance, in some embodiments the audio bitstream decoder 330 includes an audio waveform decoder reciprocal of the audio waveform encoder optionally included in the audio bitstream encoder 240.

In some embodiments the decoded SES output from the decoder 330 includes a two-channel stereo signal compatible with standard two-channel stereo reproduction. This signal can be provided directly to a legacy playback system 340, such as a pair of loudspeakers, without requiring further decoding or processing (other than digital to analog conversion and amplification of the individual left and right audio signals). As described previously, the backward compatible stereo signal included in the SES is such that it provides a viable reproduction of the original captured audio scene on the legacy playback system 340. In alternate embodiments, the legacy playback system 340 may be a multichannel playback system, such as a 5.1 or 7.1 surround-sound reproduction system and the decoded SES provided by the audio bitstream decoder 330 may include a multichannel signal directly compatible with legacy playback system 340.

In embodiments where the decoded SES is provided directly to a two-channel or multichannel legacy playback system 340, any side information (such as additional metadata or audio waveform channels) included in the audio bitstream may be simply ignored by audio bitstream decoder 330. Therefore, the entire playback component 130 may be a legacy audio or AN playback device, such as any existing mobile phone or computer. In some embodiments capture component 110 and distribution component 120 are backward-compatible with any legacy audio or video media playback device.

In some embodiments optional spatial audio decoders are applied to the SES output from the audio bitstream decoder 330. As shown in FIG. 3, a SES headphone decoder 350 performs SES decoding for a headphone output and playback by headphones 355. A SES stereo decoder 360 performs SES decoding to generate a stereo loudspeaker output to a stereo loudspeaker playback system 365. A SES multichannel decoder 370 performs SES decoding to generate a multichannel loudspeaker output to a multichannel loudspeaker playback system 375. Each of these SES decoders performs a decoding algorithm specifically tailored for the corresponding playback configuration. Embodiments of the playback component 130 include one or more of the above-described SES decoders for arbitrary playback configurations. Regardless of the playback configuration, these SES decoders do not require information about the original capture or recording configuration. For example, in some embodiments a SES decoder comprises an Ambisonic UHJ to B-format decoder followed by a B-format spatial decoder tailored for a specific playback configuration, as described, for instance, in "Ambisonics in multichannel broadcasting and video," Michael Gerzon, JAES Vol 33, No 11, Nov. 1985 p. 859-871.

By way of example, in embodiments supporting headphone playback the SES is decoded by the SES headphone decoder 350 to output a binaural signal reproducing the encoded audio scene. This is achieved by decoding embedded spatial audio cues and applying appropriate directional filtering, such as head-related transfer functions (HRTFs). In some embodiments this may involve a UHJ to B-format decoder followed by a binaural transcoder. The decoder may also support head-tracking such that the orientation of the reproduced audio scene may be automatically adjusted during headphone playback to continuously compensate for changes in the listener's head orientation, thus reinforcing the listener's illusion of being immersed in the originally captured sound field.

As an example of an embodiment of the playback component 130 connected to a two-channel loudspeaker system (such as standalone loudspeakers or loudspeakers built into a laptop or tablet computer, a TV set, or a sound bar enclosure), the SES is first spatially decoded by the SES stereo decoder 360. In some embodiments the decoder 360 includes a SES decoder equivalent to the SES headphone decoder 350, whose binaural output signal may be further processed by an appropriate crosstalk cancellation circuit to provide a faithful reproduction of the spatial cues encoded in the SES (tailored for the particular two-channel loudspeaker playback configuration).

As an example of an embodiment of playback component 130 connected to a multichannel loudspeaker system, the SES is first spatially decoded by the SES multichannel decoder 370. The configuration of the multichannel loudspeaker playback system 375 may be a standard 5.1 or 7.1 surround sound system configuration or any arbitrary surround-sound or immersive three-dimensional configuration including, for instance, height channels (such as a 22.2 system configuration).

The operations performed by the SES multichannel decoder 370 may include reformatting a two-channel or multi-channel signal included in the SES. This reformatting is done in order to faithfully reproduce the spatial audio scene encoded in the SES according to the loudspeaker output layout and optional additional metadata or side information included in the SES. In some embodiments the SES includes a two-channel or multichannel UHJ or B-format signal, and the SES multichannel decoder 370 includes a spatial decoder optimized for the specific playback configuration.

In other embodiments where the SES includes a backward-compatible two-channel stereo signal viable for standard two-channel stereo playback, alternative two channel encode/decode schemes may be employed in order to overcome the known limitations of UHJ encode/decode methods in terms of spatial audio fidelity. For example, the SES encoder may also make use of two-channel frequency-domain phase-amplitude encoding methods which can perform spatial encoding in multiple frequency bands, in order to achieve improved spatial cue resolution and preserve three-dimensional information. Additionally, the combination of such spatial encoding methods and optional metadata extraction in the SES encoder enables further enhancement in the fidelity and accuracy of the reproduced audio scene relative to the originally captured sound field.

In some embodiments the SES decoder resides on a playback device having a default playback configuration that is most suitable for an assumed listening scenario. For example, headphone reproduction may be the assumed listening scenario for a mobile device or camera, so that the SES decoder may be configured with headphones as the default decoding format. As another example, a 7.1 multichannel surround system may be the assumed playback configuration for a home theater listening scenario, so a SES decoder residing on a home theater device may be configured with 7.1 multichannel surround as the default playback configuration.

II. System Details and Alternate Embodiments

The system details of various embodiments of the sound field coding system 100 and method will now be discussed. It should be noted that only a few of the several ways in which the components, systems, and codecs may be implemented are detailed below. Many variations are possible from those which are shown and described herein.

Flexible Immersive Audio Capture and Spatial Encoding Embodiments

Figure 4:
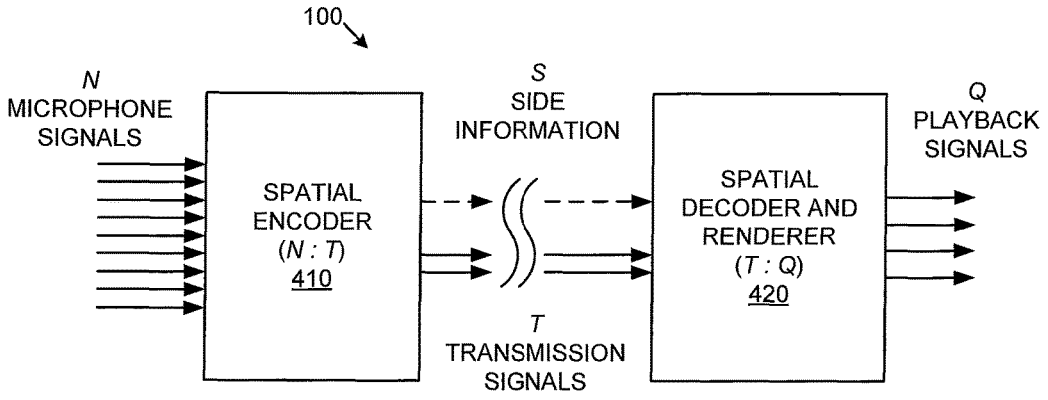
FIG. 4 illustrates a general block diagram of embodiments of a sound field coding system according to the present invention.

FIG. 4 illustrates a general block diagram of embodiments of the spatial encoder and decoder in the sound field coding system 100. Referring to FIG. 4, N audio signals are captured individually by N microphones to obtain N microphone signals. Each of the N microphones has a directivity pattern characterizing its response as a function of frequency and direction relative to a reference direction. In a spatial encoder 410 the N signals are combined into T signals such that each of the T signals has a prescribed directivity pattern associated to it.

In some embodiments the spatial encoder 410 also produces side information S, represented by the dashed line in FIG. 4, which in some embodiments includes spatial audio metadata and/or additional audio waveform signals. The T signals, along with the optional side information S, form a Spatially Encoded Signal (SES). The SES is transmitted or stored for subsequent use or distribution. In preferred embodiments T is less than N so that encoding the N microphone signals into the T transmission signals realizes a reduction in the amount of data needed to represent the audio scene captured by the N microphones.

In some preferred embodiments, the side information S consists of spatial cues stored at a lower data rate than that of the T audio transmission signals. This means that including the side information S generally does not substantially increase the total SES data rate. A spatial decoder and renderer 420 converts the SES into Q playback signals optimized for the target playback system (not shown). The target playback system can be headphones, a two-channel loudspeaker system, a five-channel loudspeaker system, or some other playback configuration.

It should be noted that in FIG. 4 the number of transmission signals T is depicted as 2 without loss of generality. Other design choices for the number of transmission channels are included within the scope of this invention. For instance, in some embodiments, T may be chosen to be 1. In these embodiments the transmission signal may be a monophonic down-mix of the N captured signals and some spatial side information S may be included in the SES in order to encode spatial cues representative of the captured sound field. In other embodiments, T may be chosen to be greater than 2. When T is larger than 1, including spatial cues in the side information S is not necessary because it is possible to encode the spatial cues in the T audio signals themselves. By way of example, the spatial cues may be mapped to the inter-channel amplitude and phase differences between the T transmitted signals.

Figure 5:
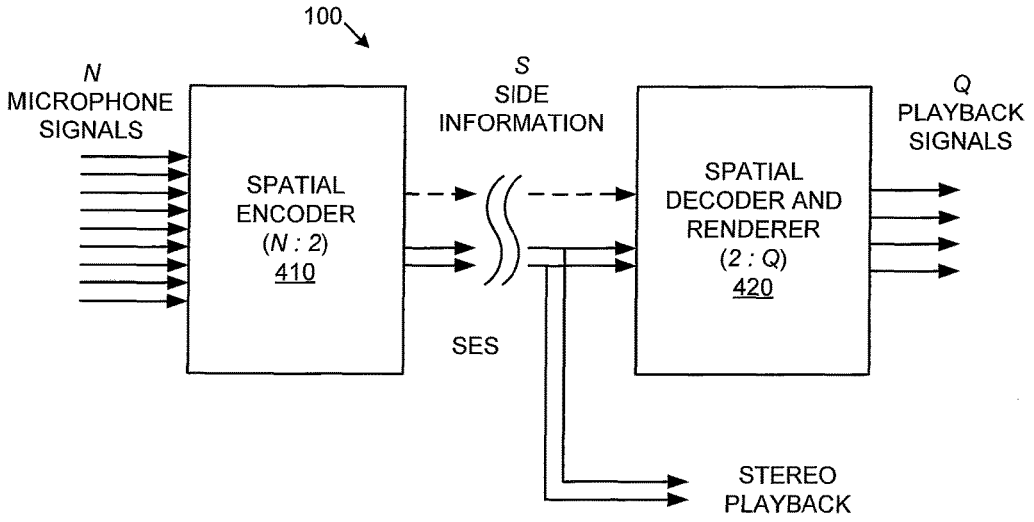
FIG. 5 is a block diagram depicting in greater detail embodiments of a system similar to that described in FIG. 4 where T=2.

FIG. 5 is a block diagram depicting in greater detail embodiments of the system 100 similar to that described in FIG. 4 where T=2. In these embodiments the N microphone signals are input to the spatial encoder 410. Spatial cues are encoded by the spatial encoder 410 into the T transmitted signals and the side information S may be omitted altogether. In some embodiments, as described previously in connection to FIG. 1 and FIG. 2, the two-channel SES is perceptually coded using standard waveform coders (such as MP3 or AAC), distributed readily over available digital distribution media or network and broadcast infrastructures, and directly played back in standard two-channel stereo configurations (using headphones or loudspeakers). In such embodiments, it is a significant advantage that the encoding and transmission system supports playback over commonly available 2-channel stereo systems without requiring a spatial decoding and rendering process.

Some embodiments of the system 100 contain a single microphone (N=1). It should be noted that in these embodiments spatial information will not be captured because there is no spatial diversity in the microphone signal. In these situations pseudo-stereo techniques (such as described, for example, in Orban, "A Rational Technique for Synthesizing Pseudo-Stereo From Monophonic Sources," JAES 18(2) (1970)) may be employed in the spatial encoder 410 to generate, from the monophonic captured audio signal, a 2-channel SES suitable for producing an artificial spatial impression when played back directly over a standard stereo reproduction system.

Some embodiments of the system 100 include the spatial decoder and renderer 420. In some preferred embodiments, the function of the spatial decoder and renderer 420 is to optimize the spatial fidelity of the reproduced audio scene for the specific playback configuration in use. For example, the spatial decoder and renderer 420 provide one or more of the following: (a) 2 output channels optimized for immersive 3-D audio reproduction in headphone playback, for instance using HRTF-based virtualization techniques; (b) 2 output channels optimized for immersive 3-D audio reproduction in playback over 2 loudspeakers, for instance using virtualization and crosstalk cancellation techniques; and (c) 5 output channels optimized for immersive 3-D audio or surround-sound reproduction in playback over 5 loudspeakers. These are representative examples of reproduction formats. In some embodiments the spatial decoder and renderer 420 is configured to provide playback signals optimized for reproduction over any arbitrary reproduction system, as explained in greater detail below.

Figure 6:
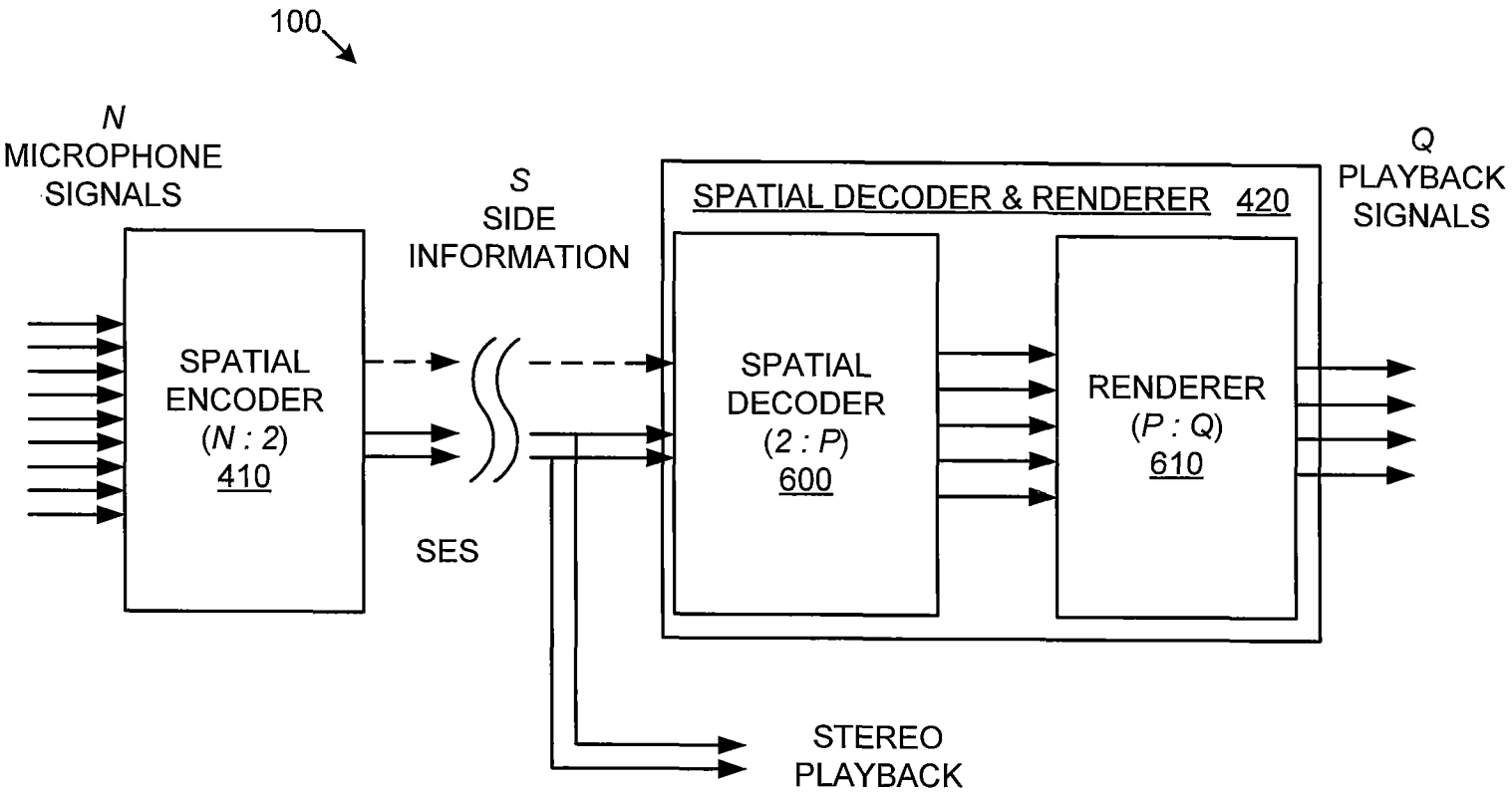
FIG. 6 is a block diagram illustrating in greater detail the spatial decoder and renderer shown in FIG. 5.

FIG. 6 is a block diagram illustrating in greater detail an embodiment of the spatial decoder and renderer 420 shown in FIGS. 4 and 5. As shown in FIG. 6, the spatial decoder and renderer 420 includes a spatial decoder 600 and a renderer 610. The SES, shown without loss of generality, includes T=2 channels with optional side information S. The decoder 600 first decodes the SES into P audio signals. In an example embodiment, the decoder 600 outputs a 5-channel matrix-decoded signal. The P audio signals are then processed to form the Q playback signals optimized for the playback configuration of the reproduction system. In one example embodiment, the SES is a 2-channel UHJ-encoded signal, the decoder 600 is a conventional Ambisonic UHJ to B-format converter, and the renderer 610 further decodes the B-format signal for the Q-channel playback configuration.

Figure 7:
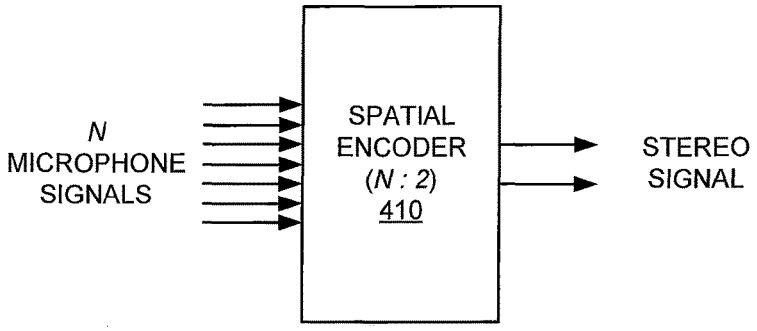
FIG. 7 is a block diagram illustrating the spatial encoder with T=2 transmission signals and no side information.

FIG. 7 is a block diagram illustrating the SES capture and encoding with T=2 transmission signals and no side information. In these embodiments the spatial encoder 410 is designed to encode N microphone signals to a stereo signal. As explained above, the choice of T=2 is compatible with common perceptual audio waveform coders (such as AAC or MP3), audio distribution media, and reproduction systems. The N microphones may be coincident microphones, nearly coincident microphones, or non-coincident microphones. The microphones may be built into a single device such as a camera, a smartphone, a field recorder, or an accessory for such devices. Additionally, the N microphone signals may be synchronized across multiple homogeneous or heterogeneous devices or device accessories.

In some embodiments the T=2 transmission channels are encoded to simulate coincident virtual microphone signals, because coincidence (time alignment of the signals) is advantageous for facilitating high-quality spatial decoding. In embodiments where non-coincident microphones are used, provision for time alignment based on analyzing the direction of arrival and applying a corresponding compensation may be incorporated in the SES encoder. In alternate embodiments, the stereo signal may be derived to correspond to binaural or non-coincident microphone recording signals, depending on the application and the spatial audio reproduction usage scenarios associated with the anticipated decoder.

Figure 8:
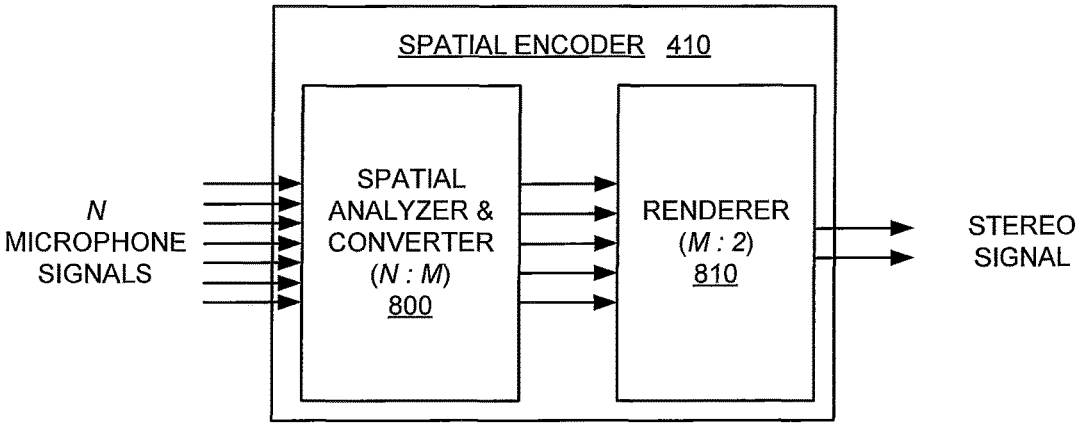
FIG. 8 is a block diagram illustrating alternate embodiments of the spatial encoder shown in FIG. 7.

FIG. 8 is a block diagram illustrating embodiments of the spatial encoder 410 shown in FIGS. 4 to 7. As shown in FIG. 8, N microphone signals are input to a spatial analyzer and converter 800 in which the N microphone signals are first converted to an intermediate format consisting of M signals. These M signals are subsequently encoded by a renderer 810 into 2 channels for transmission. The embodiment shown in FIG. 8 is advantageous when the intermediate M-channel format is more suitable for processing by the renderer 810 than the N microphone signals. In some embodiments, the conversion to the M intermediate channels may incorporate analysis of the N microphone signals. Moreover, in some embodiments the spatial conversion process 800 may include multiple conversion steps and intermediate formats.

Details of Specific Embodiments

Figure 9A:
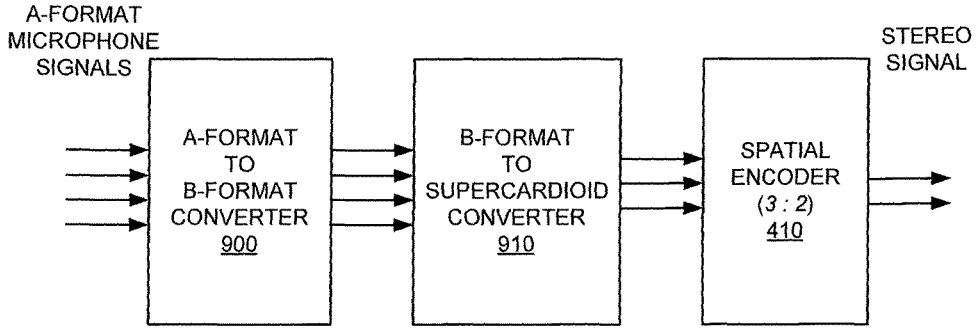
FIG. 9A illustrates a specific example embodiment of the spatial encoder where an A-format signal is captured and converted to B-format, from which a 2-channel spatially encoded signal is derived.

FIG. 9A illustrates a specific example embodiment of the spatial encoder 410 and method shown in FIG. 7 where an A-format microphone signal capture is used. The raw 4-channel A-format microphone signal can be readily converted to an Ambisonic B-format signal (W, X, Y, Z) by an A-format to B-format converter 900. Alternatively, a microphone which provides B-format signals directly may be used, in which case the A-format to B-format converter 900 is unnecessary.

Various virtual microphone directivity patterns can be formed from the B-format signal. In the present embodiment, a B-format to supercardioid converter block 910 converts the B-format signal to a set of three supercardioid microphone signals formed using these equations:

$$V_L = p\sqrt{2}W + (1-p)(X\cos\theta_L + Y\sin\theta_L)$$

$$V_R = p\sqrt{2}W + (1-p)(X\cos\theta_R + Y\sin\theta_R)$$

$$V_S = p\sqrt{2}W + (1-p)(X\cos\theta_S + Y\sin\theta_s),$$

with, for example, the design parameters set to:

$$\theta_L = -\frac{\pi}{3},\ \theta_R = \frac{\pi}{3},\ \theta_s = \pi,\ \text{and}\ p = 0.33.$$

W is the omnidirectional pressure signal in the B-format, X is the front-back figure-eight signal in the B-format, and Y is the left-right figure-eight signal in the B-format. The Z signal in the B-format (the up-down figure-eight) is not used in this conversion. $V_L$ is a virtual left microphone signal corresponding to a supercardioid having a directivity pattern steered to −60 degrees in the horizontal plane (according to the $$\theta_L = -\frac{\pi}{3}\text{radian angle}),$$

$V_R$ is a virtual right microphone signal corresponding to a supercardioid having a directivity pattern steered to +60 degrees in the horizontal plane (according to the $$\theta_R = \frac{\pi}{3}\text{radian angle}),$$

and $V_s$ is a virtual surround microphone signal corresponding to a supercardioid having a directivity pattern steered to +180 degrees in the horizontal plane (according to the 74 $_S$=π radian angle). The parameter p=0.33 is chosen in accordance with the desired directivity of the virtual microphone signals.

Figure 9B:
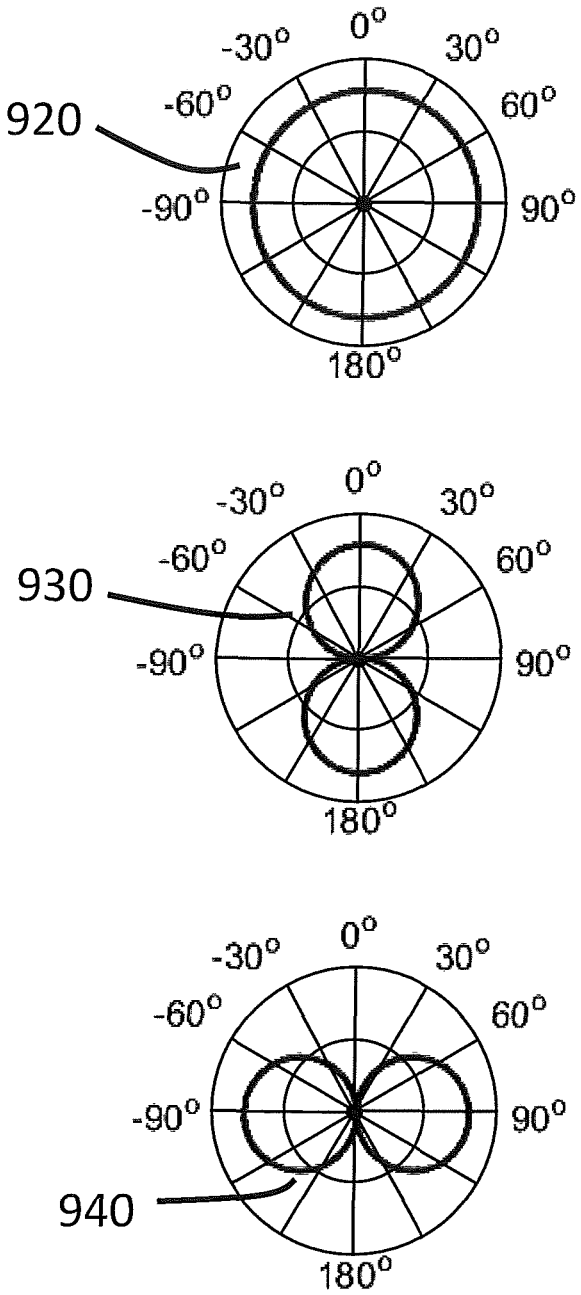
FIG. 9B illustrates the directivity patterns of the B-format W, X, and Y components in the horizontal plane.

FIG. 9B illustrates the directivity patterns of the B-format components on a linear scale. Plot 920 shows the directivity pattern of the omni-directional W component. Plot 930 shows the directivity pattern of the front-back X component, where 0 degrees is the frontal direction. Plot 940 shows the directivity pattern of the left-right Y component.

Figure 9C:
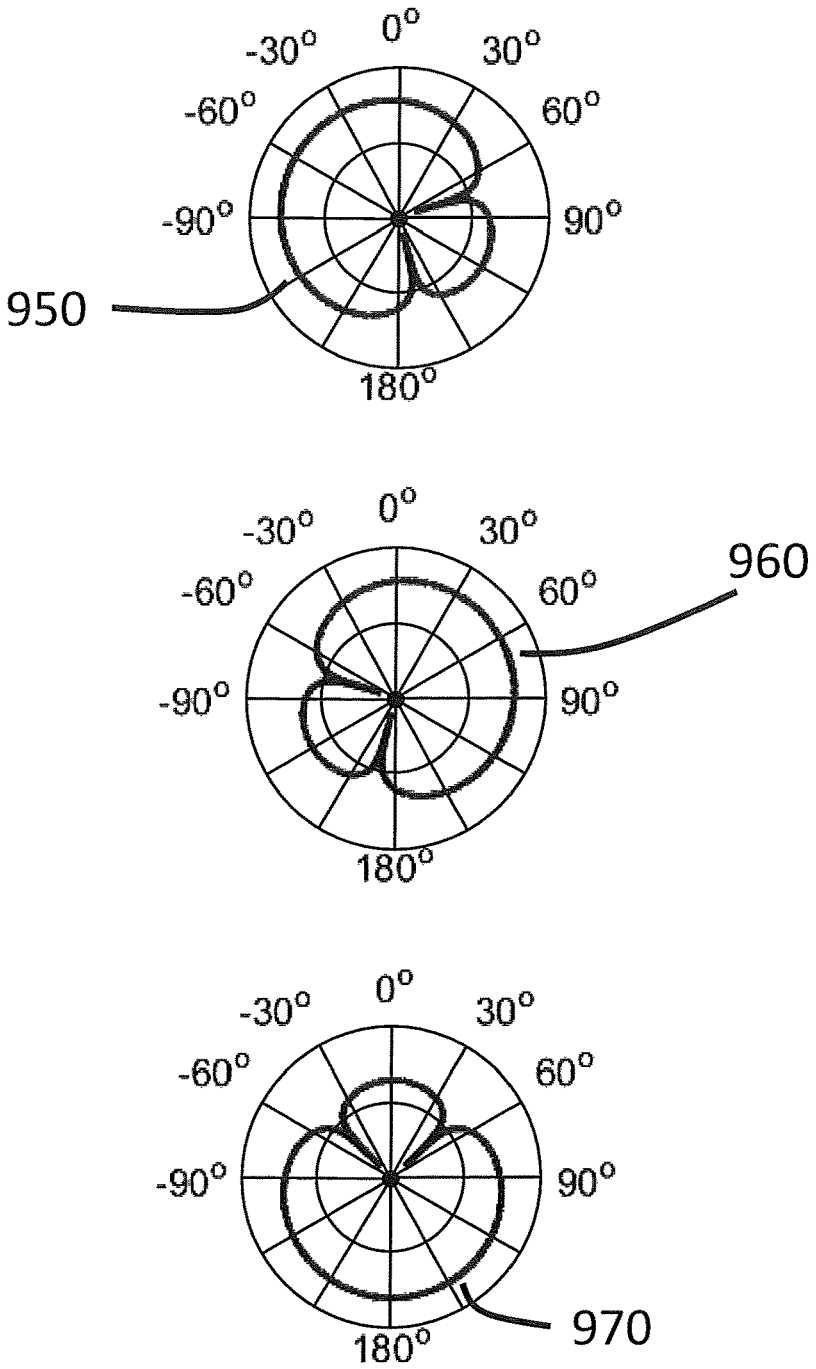
FIG. 9C illustrates the directivity patterns of 3 supercardioid virtual microphones derived by combining the B-format W, X, and Y components.

FIG. 9C illustrates the directivity patterns of the super-cardioid virtual microphones in the present embodiment on a dB scale. Plot 950 shows the directivity pattern of $V_L$, the virtual microphone steered to −60 degrees. Plot 960 shows the directivity pattern of $V_R$, the virtual microphone steered to +60 degrees. Plot 970 shows the directivity pattern of $V_S$, the virtual microphone steered to +180 degrees.

The spatial encoder 410 converts the resulting 3-channel supercardioid signal ($V_L$, $V_R$, $V_S$) produced by the converter 910 into a two-channel SES. This is achieved by using the following phase-amplitude matrix encoding equations:

$$L_T = aV_L + jbV_S$$

$$R_T = aV_R - jbV_S$$

wherein $L_T$ denotes the encoded left-channel signal, $R_T$ denotes the encoded right-channel signal, j denotes a 90-degree phase shift, a and b are the 3:2 matrix encoding weights, and $V_R$, $V_L$, and $V_S$ are the left channel virtual microphone signal, the right channel virtual microphone signal, and the surround channel virtual microphone signal, respectively. In some embodiments the 3:2 matrix encoding weights may be chosen as $$a = 1 \text{ and } b = \frac{\sqrt{2}}{2},$$

which preserves the total power of the 3-channel signal ($V_L$, $V_R$, $V_S$) in the encoded SES. As will be apparent to readers skilled in the art, the above matrix encoding equations have the effect of converting the set of three virtual microphone directivity patterns associated with the 3-channel signal ($V_L$, $V_R$,$V_S$), illustrated in FIG. 9C, into a pair of complex-valued virtual microphone directivity patterns associated with the two-channel SES ($L_T$, $R_T$).

The embodiment depicted in FIG. 9A and described above realizes a low-complexity spatial encoder which may be suitable for low-power devices and applications. Note that, within the scope of the invention, alternate directivity patterns for the intermediate 3-channel representation may be formed from the B-format signals. The resulting two-channel SES is suitable for spatial decoding using a phase-amplitude matrix decoder, such as the spatial decoder 600 shown in FIG. 6.

Figure 10:
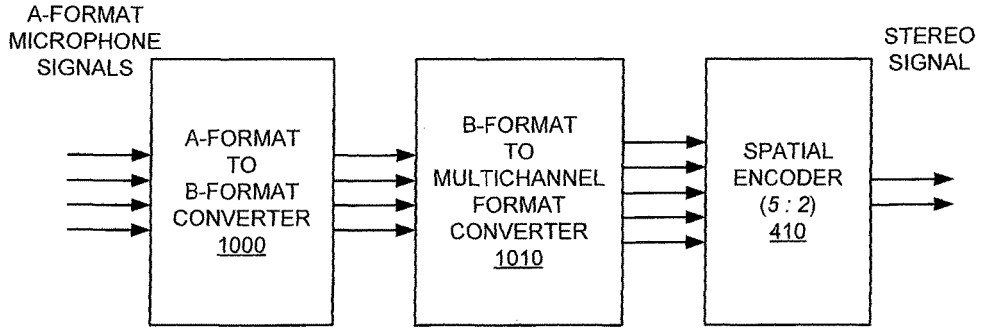
FIG. 10 illustrates an alternative embodiment of the system shown in FIG. 9A, where the B-format signal is converted into a 5-channel surround-sound signal.

FIG. 10 illustrates a specific example embodiment of the spatial encoder 410 and method shown in FIG. 7 where the B-format signal is converted into a 5-channel surround-sound signal (L, R, C, $L_s$, $R_s$). It should be noted that L denotes a front left channel, R a front right channel, C a front center channel, $L_s$ a left surround channel, and $R_s$ a right surround channel. Similar to FIG. 9A, A-format microphone signals are input to an A-format to B-format converter 1000 and converted into a B-format signal. This 4-channel B-format signal is processed by a B-format to multichannel format converter 1010, which, in some embodiments, is a multichannel B-format decoder. Next, a spatial encoder converts the 5-channel surround-sound signal produced by the converter 1010 into a two-channel SES, by using, in an embodiment, the following phase-amplitude matrix encoding equations:

$$L_T = a_1L + a_2R + a_3C + ja_4L_s - ja_5R_s$$

$$R_T = a_2L + a_1R + a_3C - ja_5L_s + ja_4R_s$$

wherein $L_T$ and $R_T$ denote respectively the left and right SES signals output by the spatial encoder. In some embodiments the matrix encoding coefficients may be chosen as $$a_1 = 1,\ a_2 = 0,\ a_3 = \sqrt{\frac{1}{2}},\ a_4 = \sqrt{\frac{2}{3}},\ \text{and } a_5 = \sqrt{\frac{1}{3}}.$$

An alternate set of matrix encoding coefficients may be used, depending on the desired spatial distribution of the front and surround channels in the two-channel encoded signal. As in the spatial encoder embodiment of FIG. 9A, the resulting two-channel SES is suitable for spatial decoding by a phase-amplitude matrix decoder, such as the spatial decoder 600 shown in FIG. 6.

In the embodiments shown in FIG. 10, the B-format signal is converted to a 5-channel intermediate surround-sound format. However, it will be apparent that, within the scope of the present invention, arbitrary horizontal surround or three-dimensional intermediate multichannel formats can be used. In these cases the operation of the converter 1010 and the spatial encoder 410 can readily be configured according to the assumed set of directions assigned to the individual intermediate channels.

Figure 11:
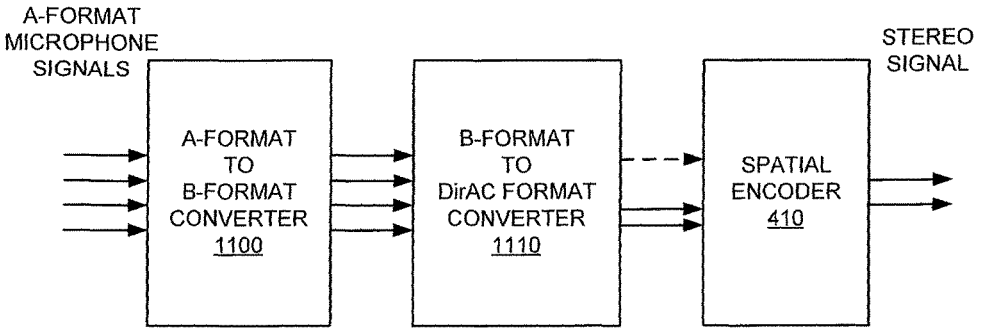
FIG. 11 illustrates an alternative embodiment of the system shown in FIG. 9A, where the B-format signal is converted into a Directional Audio Coding (DirAC) representation.

FIG. 11 illustrates a specific example embodiment of the spatial encoder 410 and method shown in FIG. 7 where the B-format signal is converted into a Directional Audio Coding (DirAC) representation. Specifically, as shown in FIG. 11, A-format microphone signals are input to an A-format to B-format converter 1100. The resultant B-format signal is converted into a DirAC-encoded signal by a B-format to DirAC format converter 1110, as described, for instance, in Pulkki, "Spatial Sound Reproduction with Directional Audio Coding", JAES Vol 55 No. 6 pp. 503-516, June 2007. The spatial encoder 410 then converts the DirAC-encoded signal into a two-channel SES. In one embodiment, this conversion is realized by converting the frequency-domain DirAc waveform data to a two-channel representation obtained, for instance, by methods described in Jot, "Two-Channel Matrix Surround Encoding for Flexible Interactive 3-D Audio Reproduction", presented at 125th AES Convention 2008 October. The resulting SES is suitable for spatial decoding by a phase-amplitude matrix decoder, such as the spatial decoder 600 shown in FIG. 6.

DirAC encoding includes a frequency-domain analysis discriminating the direct and diffuse components of the sound field. In a spatial encoder (such as the spatial encoder 410) according to the present invention, the two-channel encoding is carried out within the frequency-domain representation in order to leverage the DirAC analysis. This results in a higher degree of spatial fidelity than with conventional time-domain phase-amplitude matrix encoding techniques such as those used in the spatial encoder embodiments described in conjunction with FIG. 9A and FIG. 10.

Figure 12:
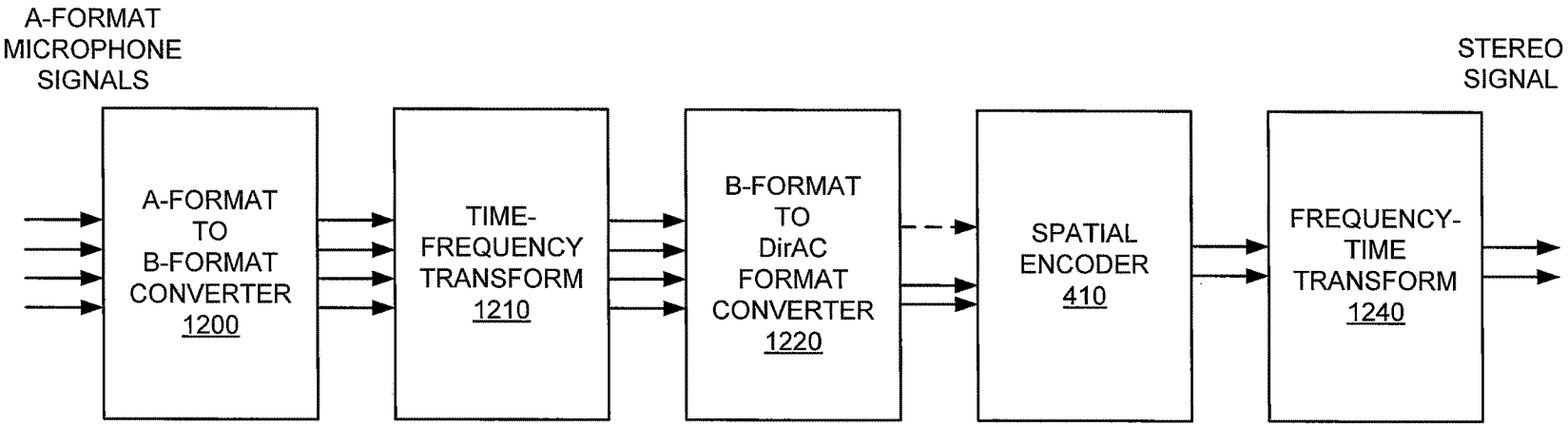
FIG. 12 is a block diagram depicting in greater detail embodiments of a system similar to that described in FIG. 11.

FIG. 12 is a block diagram illustrating in more detail an embodiment of the conversion of A-format microphone signals into a SES. As shown in FIG. 12, A-format microphone signals are converted to B-format signals using an A-format to B-format converter 1200. The B-format signal is converted to the frequency domain by using a time-frequency transform 1210. The transform 1210 is at least one of a short-time Fourier transform, a wavelet transform, a subband filter bank, or some other operation which transforms a time-domain signal into a time-frequency representation. Next, a B-format to DirAC format converter 1220 converts the B-format signal to a DirAC format signal. The DirAC signal is input to the spatial encoder 410 and spatially encoded into a two-channel SES, still represented in the frequency domain. The signals are converted back to the time domain using a frequency-time transform 1240, which is the inverse of the time-frequency transform 1210 or an approximation of that inverse transform where a perfect inversion is not possible or feasible. It should be noted that both the direct and inverse time-to-frequency transformations may be incorporated in any of the encoder embodiments according to this invention in order to improve the fidelity of the spatial encoding.

Figure 13:
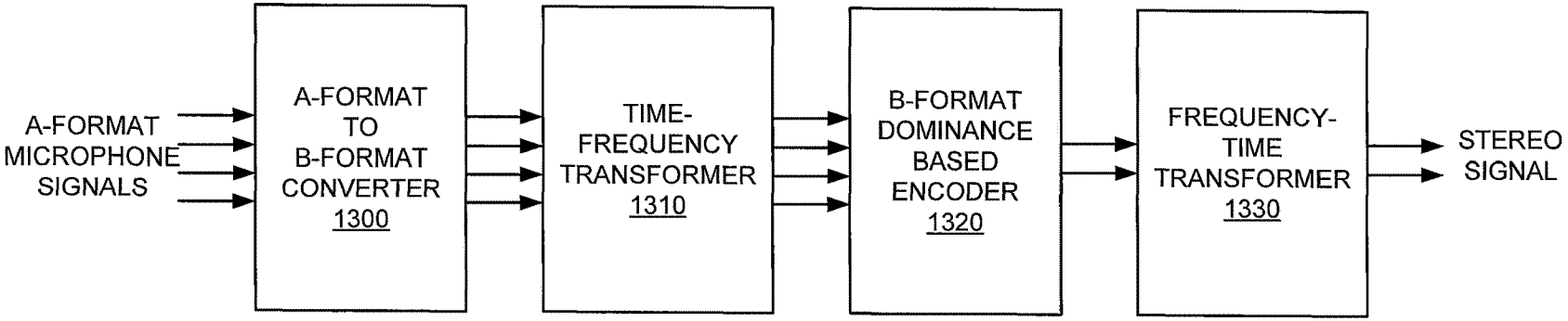
FIG. 13 is a block diagram illustrating yet another embodiment of a spatial encoder that transforms a B-format signal into the frequency-domain and encodes it as a 2-channel stereo signal.

FIG. 13 is a block diagram illustrating yet another embodiment of the spatial encoder 410 that transforms a B-format signal into the frequency-domain prior to spatial encoding. Referring to FIG. 13, A-format microphone signals are input to an A-format to B-format converter 1300. The resultant signal is converted from the time domain into the frequency domain using a time-frequency transformer 1310. The signal is encoded using a B-format dominance-based encoder 1320. In one embodiment, the SES is a two-channel stereo signal encoded according to the following equations:

$$L_T=a_L W+b_L X+c_L Y+d_L Z$$

$$R_T=a_R W+b_R X+C_R Y+d_R Z$$

where the coefficients ($a_L$, $b_L$, $C_L$, $d_L$) are time- and frequency-dependent coefficients determined from a frequency-domain 3-D dominance direction ($\alpha$, $\varphi$) calculated from the B-format signals (W, X, Y, Z) such that, if the sound field is composed of a single sound source Sat 3-D position ($\alpha$, $\varphi$), the resulting encoded signal is given by:

$$L_T=S\,k_L(\alpha,\varphi)$$

$$R_T=S\,k_R(\alpha,\varphi)$$

where $k_L$and $k_R$ are complex factors such that the left/right inter-channel amplitude and phase difference is uniquely mapped with the 3-D position ($\alpha$,$\varphi$). Example mapping formulas for this purpose are proposed, for instance, in Jot, "Two-Channel Matrix Surround Encoding for Flexible Interactive 3-D Audio Reproduction", presented at 125th AES Convention 2008 October. Such a 3-D encoding may also be performed for other channel formats. The encoded signal is transformed from the frequency domain into the time domain using a frequency-time transformer 1330.

Audio scenes may consist of discrete sound sources such as talkers or musical instruments, or diffuse sounds such as rain, applause, or reverberation. Some sounds may be partially diffuse, for example the rumble of a large engine. In a spatial encoder, it can be beneficial to treat discrete sounds (which arrive at the microphones from a distinct direction) in a different way than diffuse sounds.

Figure 14:
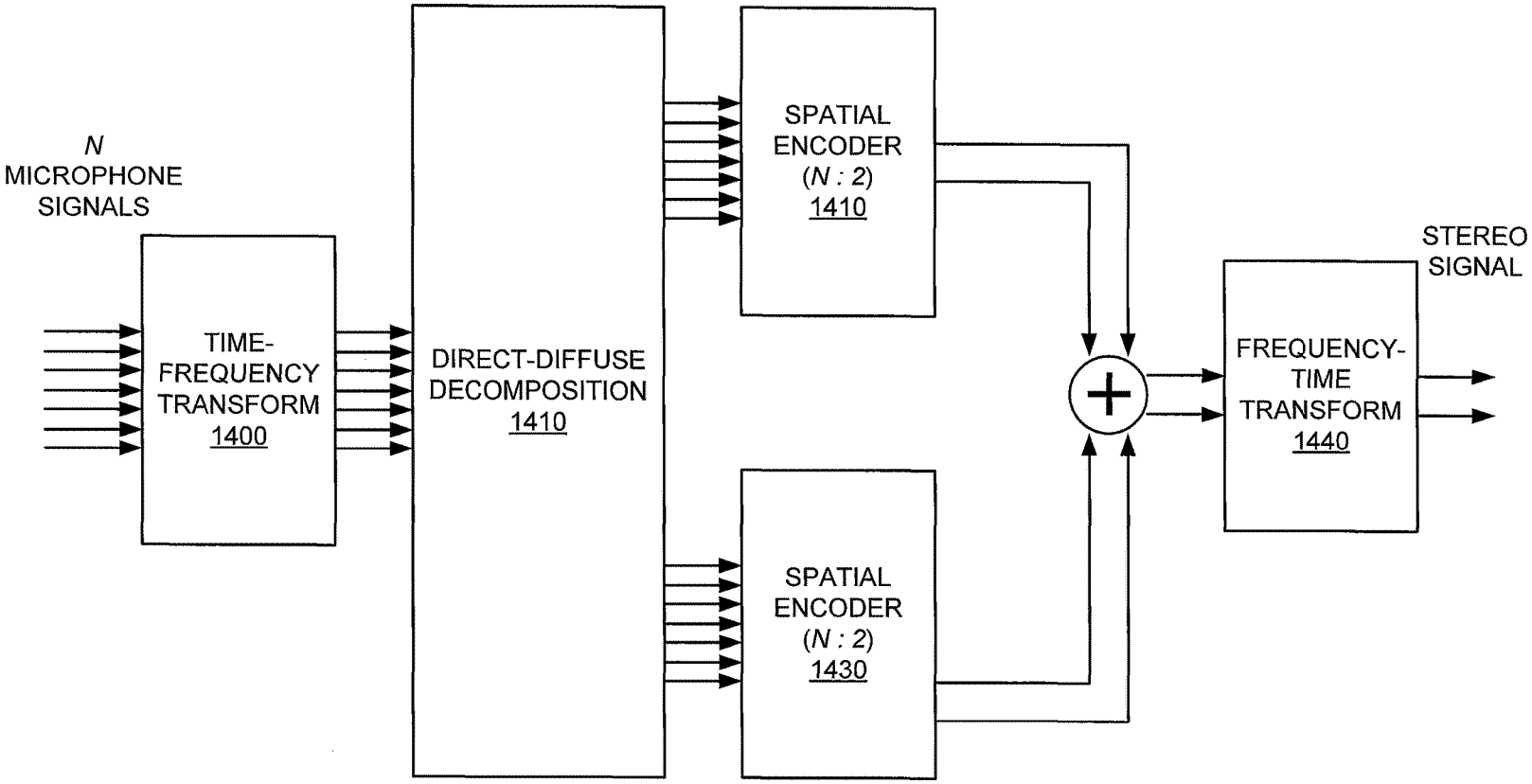
FIG. 14 is a block diagram illustrating embodiments of a spatial encoder where the input microphone signals are first decomposed into direct and diffuse components.

FIG. 14 is a block diagram illustrating embodiments of the spatial encoder 410 where the input microphone signals are first decomposed into direct and diffuse components. The direct and diffuse components are then encoded separately so as to preserve the different spatial characteristics of direct components and diffuse components. Example methods for direct/diffuse decomposition of multichannel audio signals are described for instance, in as described e.g. in Thompson et al., "Direct-Diffuse Decomposition of Multichannel Signals Using a System of Pairwise Correlations," Presented at 133rd AES Convention (2012 October). It should be understood that direct/diffuse decomposition could be used in conjunction with the various spatial encoding systems depicted earlier.

Figure 15:
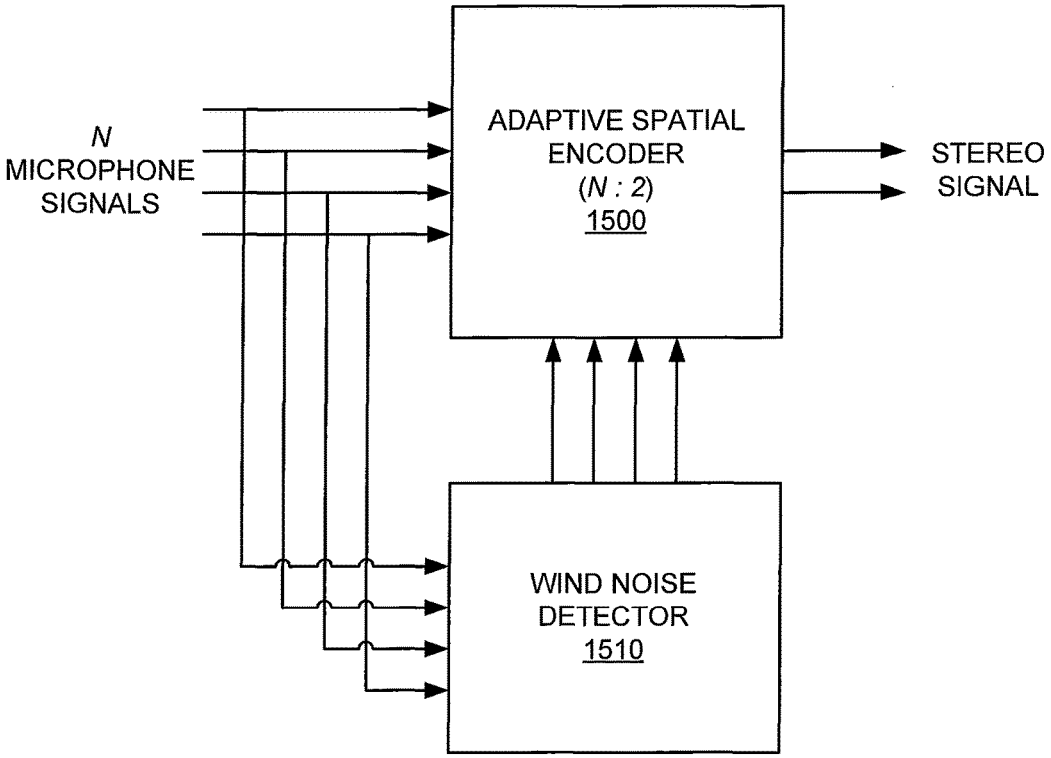
FIG. 15 is a block diagram illustrating embodiments of the spatial encoding system and method that include a wind noise detector.

Audio signals captured by microphones in outdoor settings may be corrupted by wind noise. In some cases, the wind noise may severely impact the signal quality on one or more microphones. In these and other situations it is beneficial to include a wind noise detection module. FIG. 15 is a block diagram illustrating embodiments of the system 100 and method that include a wind noise detector. As shown in FIG. 15, N microphone signals are input to an adaptive spatial encoder 1500. A wind noise detector 1510 provides an estimate of the wind noise energy or energy ratio in each microphone. Severely corrupted microphone signals may be adaptively excluded from the channel combinations used in the encoder. On the other hand, partially corrupted microphones may be down-weighted in the encoding combinations to control the amount of wind noise in the encoded signal. In some cases (such as when capturing a fast-moving outdoors action scene), the adaptive encoding based on the wind noise detection can be configured to convey at least some portion of the wind noise in the encoded audio signal.

Adaptive encoding may also be useful to account for blockage of one or more microphones from the acoustic environment, for instance by a device user's finger or by accumulated dirt on the device. In the case of blockage, the microphone provides poor signal capture and spatial information derived from the microphone signal may be misleading due to the low signal level. Detection of blockage conditions may be used to exclude blocked microphones from the encoding process.

Figure 16:
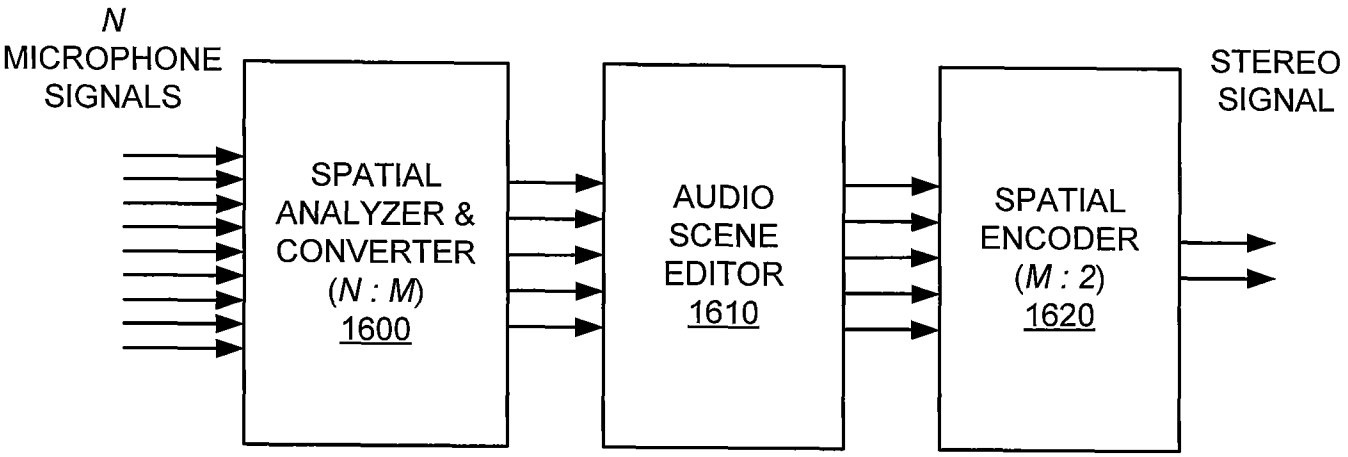
FIG. 16 illustrates a system for capturing N microphone signals and converting them to an M-channel format suitable for editing prior to spatial encoding.

In some embodiments it may be desirable to carry out editing operations on the audio scene prior to encoding the signals for storage or distribution. Such editing operations may include zooming in or out with respect to a certain sound source, removal of unwanted sound components such as background noise, and adding sound objects into the scene. FIG. 16 illustrates a system for capturing N microphone signals and converting them to an M-channel format suitable for editing.

In particular, N microphone signals are input to a spatial analyzer and converter 1600. The resultant M-channel signal output by converter 1600 is provided to an audio scene editor 1610, which is controlled by a user to effect desired modifications on the scene. After the modifications are made, the scene is spatially encoded by a spatial encoder 1620. For illustration purposes FIG. 1620 illustrates a two-channel SES format. Alternately, the N microphone signals may be directly provided to the editing tool.

In embodiments where the capture device is configured to provide only the two-channel SES format, the SES may be decoded to a multichannel format suitable for editing and then re-encoded for storage or distribution. Because the additional decode/encode process may introduce some degradations in the spatial fidelity, it is preferable to enable editing operations on a multichannel format prior to the two-channel spatial encoding. In some embodiments, a device may be configured to output a two-channel SES concurrently with the N microphone signals or the M-channel format intended for editing.

In some embodiments, the SES may be imported into a nonlinear video editing suite and manipulated as for a traditional stereo movie capture. The spatial integrity of the resulting content will remain intact post-editing provided that no spatially deleterious audio processing effects are applied to the content. The SES decoding and reformatting may also be applied as part of the video editing suite. For example, if the content is being burned to a DVD or Blu-ray disc, the multichannel speaker decode and reformat could be applied and the results encoded in a multichannel format for subsequent multichannel playback. Alternatively, the audio content may be authored "as is" for legacy stereo playback on any compatible playback hardware. In this case, SES decoding may be applied on the playback device if the appropriate reformatting algorithm is present on the device.

Figure 17:
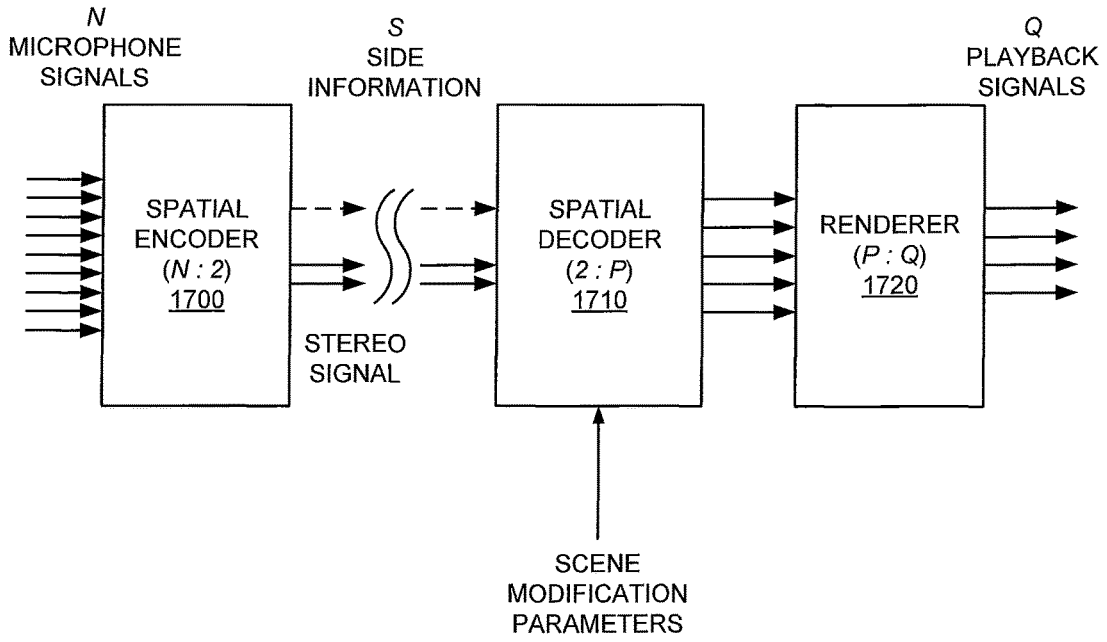
FIG. 17 illustrates embodiments of the system and method whereby the captured audio scene is modified as part of the spatial decoding process.

FIG. 17 illustrates embodiments of the system and method whereby the captured audio scene is modified as part of the decoding process. More specifically, N microphone signals are encoded by a spatial encoder 1700 as SES which, in some embodiments includes side information S. The SES is stored, transmitted, or both. A spatial decoder 1710 is used to decode the encoded SES and a renderer 1720 provides Q playback signals. Scene modification parameters are used by the decoder 1710 to modify the audio scene.

In some preferred embodiments, the scene modification occurs at a point in the decoding process where the modification can be carried out efficiently. For instance, in a virtual reality application using headphones for audio rendering, it is critical for the spatial cues of the sound scene to be updated in real time according to the motion of the user's head, so that the perceived localization of sound objects matches that of their visual counterparts. To achieve this, a head-tracking device is used to detect the orientation of the user's head. The virtual audio rendering is then continuously updated based on these estimates so that the reproduced sound scene appears independent of the listener's head motion.

The estimate of the head orientation can be incorporated in the decoding process of the spatial decoder 1710 so that the renderer 1720 reproduces a stable audio scene. This is equivalent to either rotating the scene prior to decoding or rendering to a rotated intermediate format (the P channels output by the spatial decoder) prior to virtualization. In embodiments where side information is included in the SES, such scene rotations may include manipulations of the spatial metadata included in the side information.

Other modifications of interest which may be supported in the spatial decoding process include warping the width of the audio scene and audio zoom. In some embodiments, the decoded audio signal may be spatially warped to match the original video recording's field of view. For example, if the original video used a wide angle lens, the audio scene may be stretched across a similar angular arc in order to better match audio and visual cues. In some embodiments, the audio may be modified to zoom into spatial regions of interest or to zoom out from a region; audio zoom may be coupled to a video zoom modification.

In some embodiments, the decoder may modify the spatial characteristics of the decoded signal in order to steer or emphasize the decoded signal in specific spatial locations. This may allow enhancement or reduction of the salience of certain auditory events such as conversation, for example. In some embodiments this may be facilitated through the use of a voice detection algorithm.

III. Operational Overview

Embodiments of the sound field coding system 100 and method use an arbitrary microphone array configuration to capture a sound field representing an immersive audio scene. The captured audio is encoded in a generic SES format that is agnostic to the microphone array configuration used.

Figure 18:
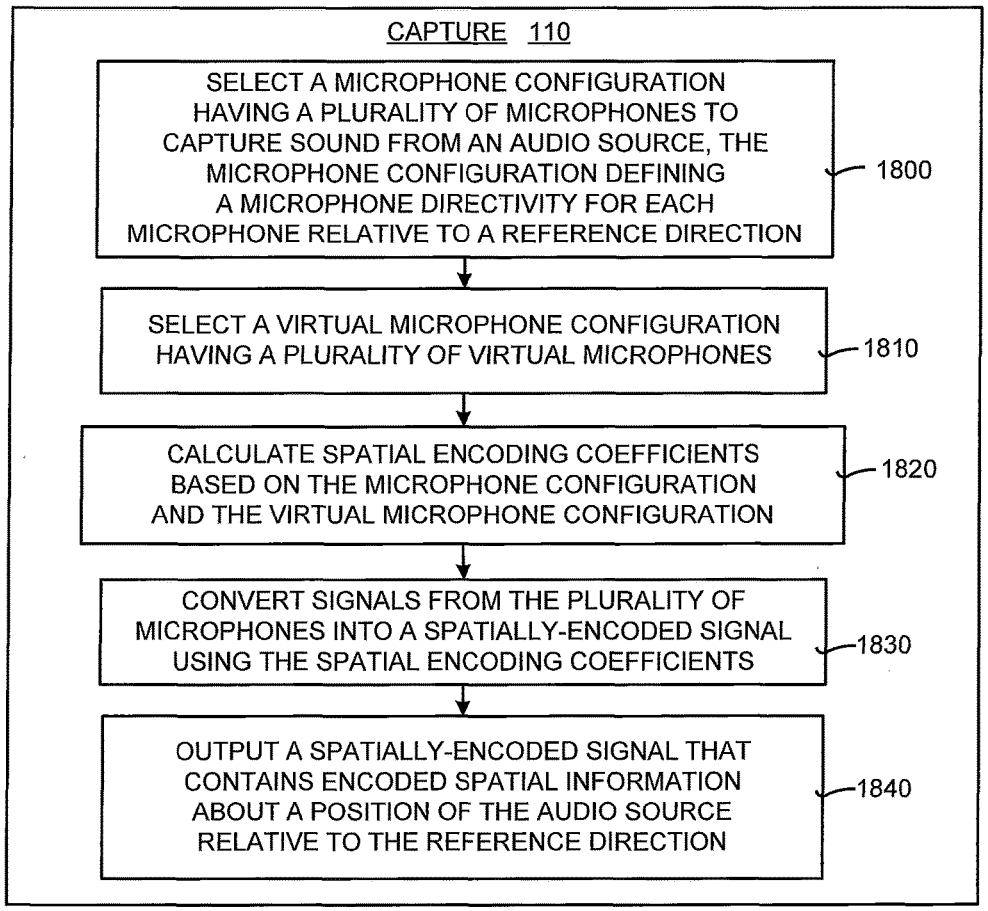
FIG. 18 is a flow diagram illustrating the general operation of embodiments of the capture component of the sound field coding system according to the present invention.

FIG. 18 is a flow diagram illustrating the general operation of embodiments of the capture component 110 of the sound field coding system 100 illustrated in FIGS. 1-17. The operation begins selecting a microphone configuration that includes a plurality of microphones (box 1800). These microphones are used to capture sound from at least one audio source. The microphone configuration defines a microphone directivity pattern for each microphone relative to a reference direction. In addition, a virtual microphone configuration is selected that includes a plurality of virtual microphones (box 1810).

The method calculates spatial encoding coefficients based on the microphone configuration and the virtual microphone configuration (box 1820). Microphone signals from the plurality of microphones are converted into a spatially-encoded signal using the spatial-encoding coefficients (box 1830). The output of the system 100 is a spatially-encoded signal (box 1840). The signal contains encoded spatial information about a position of the audio source relative to the reference direction.

As set forth above, various other embodiments of the system 100 and method are disclosed herein. By way of example and not limitation, referring again to FIG. 7 the spatial encoder 410 may be generalized from an N:2 spatial encoder to an N:T spatial encoder. Moreover, various other embodiments may be realized, within the scope of the invention, for an encoder producing a two-channel SES ($L_T$, $R_T$) compatible with direct two-channel stereo playback and with phase-amplitude matrix decoders configured for immersive audio reproduction in flexible playback configurations. In embodiments where standard microphone configurations such as the Ambisonic A or B formats are used, the two-channel encoding equations may be specified based on the formulated directivity patterns of the microphone format.

More generally, in embodiments where the microphones may be situated in a nonstandard configuration due to device design constraints or the ad hoc nature of a network of devices, the derivation of the spatially encoded signals may be formed by combinations of the microphone signals based on the relative microphone locations and measured or estimated directivities of the microphones. The combinations may be formed to optimally achieve prescribed directivity patterns suitable for two-channel SES encoding. Given the directivity patterns of the N microphones $G_n(f,\alpha,\varphi)$ as mounted on a respective recording device or accessory, where a directivity pattern is a complex amplitude factor which characterizes the response of a microphone as a function of frequency f and the 3-D position $(\alpha,\varphi)$, a set of coefficients $k_{Ln}(f)$ and $k_{Rn}(f)$ may be optimized for each microphone at each frequency to form virtual microphone directivity patterns for the left and right SES channels:

$$V_L(f,\alpha,\varphi) \approx \sum_{n=1}^{N} k_{Ln}(f) G_n(f,\alpha,\varphi)$$

$$V_R(f,\alpha,\varphi) \approx \sum_{n=1}^{N} k_{Rn}(f) G_n(f,\alpha,\varphi)$$

wherein the coefficient optimization is carried out to minimize an error criterion between the resulting left and right virtual microphone directivity patterns and the prescribed left and right directivity patterns for each encoding channel.

In some embodiments, the microphone responses may be combined to exactly form the prescribed virtual microphone directivity patterns, in which case equality would hold in the above expressions. For instance, in the embodiments described in conjunction with FIGS. 9B and 9C, the B-format microphone responses were combined to precisely achieve prescribed virtual microphone responses. In some embodiments the coefficient optimization may be carried out using an optimization method such as least-squares approximation.

The two-channel SES encoding equations are thereafter given by $$L_T(f,t)=\sum_{n=1}^{N}k_{Ln}(f)S_n(f,t)$$

$$R_T(f,t)=\sum_{n=1}^{N}k_{Rn}(f)S_n(f,t)$$

wherein $L_T(f,t)$ and $R_T(f,t)$ respectively denote frequency-domain representations of the left and right SES channels, and $S_n(f,t)$ denotes the frequency-domain representation of the n-th microphone signal.

Similarly, in some embodiments in accordance with FIG. 4, optimal directivity patterns for T virtual microphones corresponding to T encoded signals may be formed, where T is not equal to two. In embodiments in accordance with FIG. 8, optimal directivity patterns for M virtual microphones may be formed corresponding to M channels in an intermediate format, where each channel in the intermediate format has a prescribed directivity pattern; the M channels in the intermediate format are subsequently encoded to two channels. In other embodiments, the M intermediate channels may be encoded to T channels where T is not equal to two.

From the description of the various embodiments above, it should be understood that the invention may be used to encode any microphone format; and furthermore, that if the microphone format provides directionally selective responses, the spatial encoding/decoding may preserve the directional selectivity. Other microphone formats which may be incorporated in the capture and encoding system include but are not limited to XY stereo microphones and non-coincident microphones, which may be time-aligned based on frequency-domain spatial analysis to support matrix encoding and decoding.

From the description of the frequency-domain operation incorporated in various embodiments above, it should be understood that a frequency-domain analysis may be carried out in conjunction with any of the embodiments in order to increase the spatial fidelity of the encoding process; in other words, frequency-domain processing will result in the decoded scene more accurately matching the captured scene than a purely time-domain approach, at the cost of additional computation to perform the time-frequency transformation, the frequency-domain analysis, and the inverse transformation after spatial encoding.

IV. Exemplary Operating Environment

Many other variations than those described herein will be apparent from this document. For example, depending on the embodiment, certain acts, events, or functions of any of the methods and algorithms described herein can be performed in a different sequence, can be added, merged, or left out altogether (such that not all described acts or events are necessary for the practice of the methods and algorithms). Moreover, in certain embodiments, acts or events can be performed concurrently, such as through multi-threaded processing, interrupt processing, or multiple processors or processor cores or on other parallel architectures, rather than sequentially. In addition, different tasks or processes can be performed by different machines and computing systems that can function together.

The various illustrative logical blocks, modules, methods, and algorithm processes and sequences described in connection with the embodiments disclosed herein can be implemented as electronic hardware, computer software, or combinations of both. To clearly illustrate this interchangeability of hardware and software, various illustrative components, blocks, modules, and process actions have been described above generally in terms of their functionality. Whether such functionality is implemented as hardware or software depends upon the particular application and design constraints imposed on the overall system. The described functionality can be implemented in varying ways for each particular application, but such implementation decisions should not be interpreted as causing a departure from the scope of this document.

The various illustrative logical blocks and modules described in connection with the embodiments disclosed herein can be implemented or performed by a machine, such as a general purpose processor, a processing device, a computing device having one or more processing devices, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor and processing device can be a microprocessor, but in the alternative, the processor can be a controller, microcontroller, or state machine, combinations of the same, or the like. A processor can also be implemented as a combination of computing devices, such as a combination of a DSP and a microprocessor, a plurality of microprocessors, one or more microprocessors in conjunction with a DSP core, or any other such configuration.

Embodiments of the sound field coding system and method described herein are operational within numerous types of general purpose or special purpose computing system environments or configurations. In general, a computing environment can include any type of computer system, including, but not limited to, a computer system based on one or more microprocessors, a mainframe computer, a digital signal processor, a portable computing device, a personal organizer, a device controller, a computational engine within an appliance, a mobile phone, a desktop computer, a mobile computer, a tablet computer, a smartphone, and appliances with an embedded computer, to name a few.

Such computing devices can typically be found in devices having at least some minimum computational capability, including, but not limited to, personal computers, server computers, hand-held computing devices, laptop or mobile computers, communications devices such as cell phones and PDA's, multiprocessor systems, microprocessor-based systems, set top boxes, programmable consumer electronics, network PCs, minicomputers, mainframe computers, audio or video media players, and so forth. In some embodiments the computing devices will include one or more processors. Each processor may be a specialized microprocessor, such as a digital signal processor (DSP), a very long instruction word (VLIW), or other micro-controller, or can be conventional central processing units (CPUs) having one or more processing cores, including specialized graphics processing unit (GPU)-based cores in a multi-core CPU.

The process actions of a method, process, or algorithm described in connection with the embodiments disclosed herein can be embodied directly in hardware, in a software module executed by a processor, or in any combination of the two. The software module can be contained in computer-readable media that can be accessed by a computing device. The computer-readable media includes both volatile and nonvolatile media that is either removable, non-removable, or some combination thereof. The computer-readable media is used to store information such as computer-readable or computer-executable instructions, data structures, program modules, or other data. By way of example, and not limitation, computer readable media may comprise computer storage media and communication media.

Computer storage media includes, but is not limited to, computer or machine readable media or storage devices such as Blu-ray discs (BD), digital versatile discs (DVDs), compact discs (CDs), floppy disks, tape drives, hard drives, optical drives, solid state memory devices, RAM memory, ROM memory, EPROM memory, EEPROM memory, flash memory or other memory technology, magnetic cassettes, magnetic tapes, magnetic disk storage, or other magnetic storage devices, or any other device which can be used to store the desired information and which can be accessed by one or more computing devices.

A software module can reside in the RAM memory, flash memory, ROM memory, EPROM memory, EEPROM memory, registers, hard disk, a removable disk, a CD-ROM, or any other form of non-transitory computer-readable storage medium, media, or physical computer storage known in the art. An exemplary storage medium can be coupled to the processor such that the processor can read information from, and write information to, the storage medium. In the alternative, the storage medium can be integral to the processor. The processor and the storage medium can reside in an application specific integrated circuit (ASIC). The ASIC can reside in a user terminal. Alternatively, the processor and the storage medium can reside as discrete components in a user terminal.

The phrase "non-transitory" as used in this document means "enduring or long-lived". The phrase "non-transitory computer-readable media" includes any and all computer-readable media, with the sole exception of a transitory, propagating signal. This includes, by way of example and not limitation, non-transitory computer-readable media such as register memory, processor cache and random-access memory (RAM).

Retention of information such as computer-readable or computer-executable instructions, data structures, program modules, and so forth, can also be accomplished by using a variety of the communication media to encode one or more modulated data signals, electromagnetic waves (such as carrier waves), or other transport mechanisms or communications protocols, and includes any wired or wireless information delivery mechanism. In general, these communication media refer to a signal that has one or more of its characteristics set or changed in such a manner as to encode information or instructions in the signal. For example, communication media includes wired media such as a wired network or direct-wired connection carrying one or more modulated data signals, and wireless media such as acoustic, radio frequency (RF), infrared, laser, and other wireless media for transmitting, receiving, or both, one or more modulated data signals or electromagnetic waves. Combinations of any of the above should also be included within the scope of communication media.

Further, one or any combination of software, programs, computer program products that embody some or all of the various embodiments of the sound field coding system and method described herein, or portions thereof, may be stored, received, transmitted, or read from any desired combination of computer or machine readable media or storage devices and communication media in the form of computer executable instructions or other data structures.

Embodiments of the sound field coding system and method described herein may be further described in the general context of computer-executable instructions, such as program modules, being executed by a computing device. Generally, program modules include routines, programs, objects, components, data structures, and so forth, which perform particular tasks or implement particular abstract data types. The embodiments described herein may also be practiced in distributed computing environments where tasks are performed by one or more remote processing devices, or within a cloud of one or more devices, that are linked through one or more communications networks. In a distributed computing environment, program modules may be located in both local and remote computer storage media including media storage devices. Still further, the aforementioned instructions may be implemented, in part or in whole, as hardware logic circuits, which may or may not include a processor.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

While the above detailed description has shown, described, and pointed out novel features as applied to various embodiments, it will be understood that various omissions, substitutions, and changes in the form and details of the devices or algorithms illustrated can be made without departing from the scope of the disclosure. As will be recognized, certain embodiments of the inventions described herein can be embodied within a form that does not provide all of the features and benefits set forth herein, as some features can be used or practiced separately from others.

Moreover, although the subject matter has been described in language specific to structural features and methodological acts, it is to be understood that the subject matter defined in the appended claims is not necessarily limited to the specific features or acts described above. Rather, the specific features and acts described above are disclosed as example forms of implementing the claims.

What is claimed is:

1. A method for processing a plurality of capture microphone signals, comprising:

selecting a capture microphone configuration having a plurality of capture microphones for capturing sound from at least one audio source, the capture microphone configuration defining a microphone directivity for each of the plurality of capture microphones relative to a reference direction;

selecting a virtual microphone configuration having a plurality of virtual microphones for encoding spatial information about a position of the at least one audio source relative to the reference direction, the virtual microphone configuration defining a virtual microphone directivity for each of the virtual microphones relative to the reference direction;

adapting the capture microphone configuration based on detection of an adverse condition for microphone performance for at least one of the plurality of capture microphones to obtain an adapted capture microphone configuration;

calculating spatial encoding coefficients based on the adapted capture microphone configuration and on the virtual microphone configuration; and converting the plurality of capture microphone signals into a Spatially Encoded Signal (SES) including virtual microphone signals;

wherein each of the virtual microphone signals is obtained by combining the capture microphone signals using the spatial encoding coefficients.

2. The method of claim 1, wherein adapting the capture microphone configuration based on detection of the adverse condition for microphone performance for at least one of the plurality of capture microphones further comprises:

identifying one or more microphones in the plurality of capture microphones for which the adverse condition for microphone performance is present; and adapting the capture microphone configuration based on detection of the adverse condition for microphone performance comprises excluding the one or more identified capture microphones for which the adverse condition is detected from the plurality of capture microphones for which spatial encoding coefficients are calculated.

3. The method of claim 2, wherein the adverse condition for microphone performance is excessive wind noise.

4. The method of claim 2, wherein the adverse condition for microphone performance is microphone blockage.

5. The method of claim 1, wherein the spatial information is encoded in the form of one of: (a) inter-channel amplitude; and (b) phase differences.

6. The method of claim 5, further comprising selecting a virtual microphone configuration having a plurality of virtual microphones for encoding spatial information about a position of the audio source relative to the reference direction.

7. The method of claim 1, wherein the plurality of microphone signals are A-format microphone signals, further comprising converting the A-format microphone signals into B-format microphone signals.

8. The method of claim 7, further comprising forming a virtual microphone directivity pattern from the B-format microphone signals.

9. The method of claim 8, further comprising using the following equations to form the virtual microphone directivity pattern:

$$V_L=p\sqrt{2}W+(1-p)(X\cos\theta_L+Y\sin\theta_L)$$

$$V_R=p\sqrt{2}W+(1-p)(X\cos\theta_R+R\sin\theta_R)$$

$$V_S=p\sqrt{2}W+(1-p)(X\cos\theta_S+S\sin\theta_R)$$

where $\theta_L$, $\theta_R$, $\theta_S$, and p are design parameters, W is an omnidirectional pressure signal in the B-format, X is a front-back figure-eight signal in the B-format, Y is a left-right figure-eight signal in the B-format, $V_L$ is a virtual left microphone signal in a horizontal plane, $V_R$ is a virtual right microphone signal corresponding to a supercardioid in the horizontal plane, and $V_s$ is a virtual surround microphone signal corresponding to a supercardioid in the horizontal plane.

10. The method of claim 9, further comprising selecting the design parameter p in accordance with a desired directivity of the virtual microphone signals.

11. A method for processing a plurality of capture microphone signals, comprising:

decomposing the plurality of capture microphone signals into a plurality of direct components and a plurality of diffuse components;

selecting a first capture microphone configuration for the direct components having a first plurality of capture microphones for capturing sound from at least one audio source, the first capture microphone configuration defining a first microphone directivity for each of the first plurality of capture microphones relative to a first reference direction;

selecting a first virtual microphone configuration for the direct components having a first plurality of virtual microphones for encoding spatial information about a position of the at least one audio source relative to the reference direction, the first virtual microphone configuration defining a first virtual microphone directivity for each of the virtual microphones relative to the first reference direction;

selecting a second capture microphone configuration for the diffuse components having a second plurality of capture microphones for capturing sound from at least one audio source, the second capture microphone configuration defining a second microphone directivity for each of the second plurality of capture microphones relative to a second reference direction;

selecting a second virtual microphone configuration for the diffuse components having a second plurality of virtual microphones for encoding spatial information about a position of the at least one audio source relative to the second reference direction, the second virtual microphone configuration defining a second virtual microphone directivity for each of the virtual microphones relative to the second reference direction;

calculating spatial encoding coefficients for the direct components based on the first capture microphone configuration for the direct components and on the first virtual microphone configuration;

calculating spatial encoding coefficients for the diffuse components based on the second capture microphone configurations for the diffuse components and on the second virtual microphone configuration;

converting the plurality of direct components into a direct-component Spatially Encoded Signal (SES) including virtual microphone signals for the direct components, wherein each of the virtual microphone signals for the direct components is obtained by combining the direct components using the spatial encoding coefficients for the direct components;

converting the plurality of diffuse components into a diffuse-component Spatially Encoded Signal (SES) including virtual microphone signals for the diffuse components, wherein each of the virtual microphone signals for the diffuse components is obtained by combining the diffuse components using the spatial encoding coefficients for the diffuse components; and combining the direct-component Spatially Encoded Signal and the diffuse-component Spatially Encoded Signal to form an output Spatially Encoded Signal.

12. The method of claim 11, further comprising defining at least one of the capture and virtual microphone directivities for the direct components as a frequency-dependent amplitude scaling factor that depends on the position of the at least one audio source.

13. The method of claim 11, further comprising defining at least one of the capture and virtual microphone directivities for the diffuse components as a frequency-dependent amplitude scaling factor that depends on the position of the at least one audio source.

14. The method of claim 11, wherein the spatial information is carried in part in the form of positional audio metadata.

* * * * *